US008142298B2

(12) United States Patent
King et al.

(10) Patent No.: US 8,142,298 B2
(45) Date of Patent: Mar. 27, 2012

(54) INTERACTIVE ACTIVITY SYSTEM

(75) Inventors: Steve King, Maple Plain, MN (US); Tom Felber, Hutchinson, MN (US)

(73) Assignee: Landscape Structures, Inc., Delano, MN (US)

( * ) Notice: Subject to any disclaimer, the term of this patent is extended or adjusted under 35 U.S.C. 154(b) by 1330 days.

(21) Appl. No.: 11/494,055

(22) Filed: Jul. 27, 2006

(65) Prior Publication Data

US 2007/0049384 A1 Mar. 1, 2007

Related U.S. Application Data

(60) Provisional application No. 60/702,758, filed on Jul. 27, 2005.

(51) Int. Cl.

| | |
|---|---|
| ***A63G 31/00*** | (2006.01) |
| ***F02B 63/04*** | (2006.01) |
| ***A63B 71/00*** | (2006.01) |

(52) U.S. Cl. ..... 472/137; 472/59; 290/1 R; 482/2; 463/7

(58) Field of Classification Search ..... 463/6–7; 434/61, 66; 180/218, 220–221; 290/1 R; 482/1–2, 4; 472/57–59, 134
See application file for complete search history.

(56) References Cited

U.S. PATENT DOCUMENTS

| | | | | |
|---|---|---|---|---|
| 4,817,939 | A * | 4/1989 | Augspurger et al. | 482/61 |
| 5,364,271 | A * | 11/1994 | Aknin et al. | 434/61 |
| 5,888,172 | A * | 3/1999 | Andrus et al. | 482/7 |
| 7,044,891 | B1 * | 5/2006 | Rivera | 482/8 |
| 7,504,737 | B2 * | 3/2009 | Vasilovich et al. | 290/1 R |
| 2005/0130741 | A1 * | 6/2005 | Pandian | 463/36 |
| 2005/0233285 | A1 * | 10/2005 | Miyamaru et al. | 434/61 |

* cited by examiner

*Primary Examiner* — Dmitry Suhol
*Assistant Examiner* — Alex F. R. P. Rada, II
(74) *Attorney, Agent, or Firm* — Westman, Champlin & Kelly, P.A.

(57) ABSTRACT

An interactive activity system is disclosed. One embodiment includes a generator configured to produce electrical power based on physical interaction with a human being, a storage component configured to store the electrical power, and at least one play-oriented application configured to utilize a portion of the electrical power for operation. In one embodiment, the interactive activity system is implemented in a traditional, non-electronic playground environment.

13 Claims, 24 Drawing Sheets

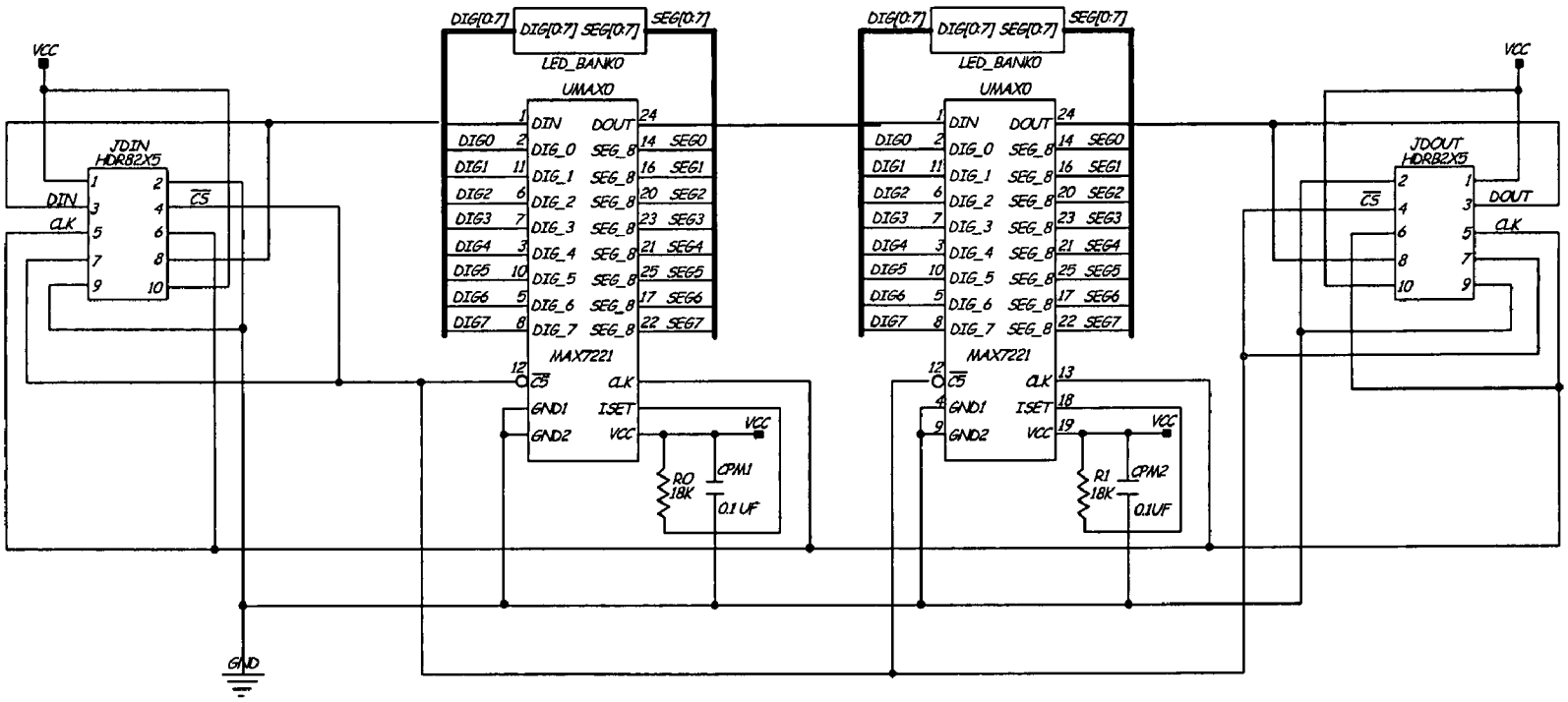
Fig. 6A
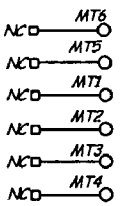

INTERACTIVE ACTIVITY SYSTEM

The present application is based on and claims the benefit of U.S. Provisional Patent Application Ser. No. 60/702,758, filed on Jul. 27, 2005, the content of which is hereby incorporated by reference in its entirety.

BACKGROUND OF THE INVENTION

In recent years, relatively passive activities such as, but certainly not limited to, video game playing and TV watching have become increasingly popular in young people. In many cases, children are substituting passive activities in place of activities that inherently involve exercise. This is a bad outcome at least in that inactivity can lead to a wide variety of different health complications. Such complications could include, for example, heart disease and/or obesity.

Many efforts have and are being made to encourage children to establish an active lifestyle that will lead to good health later in life. As part of these efforts, children are being encouraged to invest playtime in activities that involve significant physical stimulation. In one example, children are encouraged to play on indoor or outdoor play structures designed to promote physical stimulation (e.g., playground equipment).

It is at least arguably true that the design of play structures has at least partially failed to adapt to the changing interests of children. For example, children have become increasingly attracted to electronics-based activities such as computer and video games. In fact, it is likely true that that some children prefer electronics-based activities to activities associated with traditional play structures.

For at least these reasons, there exists a need for a play system that blends electronics-based activities into a more traditional play environment.

SUMMARY OF THE INVENTION

An interactive activity system is disclosed. One embodiment includes a generator configured to produce electrical power based on physical interaction with a human being, a storage component configured to store the electrical power, and at least one play-oriented application configured to utilize a portion of the electrical power for operation. In one embodiment, the interactive activity system is implemented in a traditional playground environment.

BRIEF DESCRIPTION OF THE DRAWINGS

FIGS. 6A-6C are technical diagrams demonstrating circuitry associated with the display.

DETAILED DESCRIPTION OF ILLUSTRATED EMBODIMENTS

Figure 1:
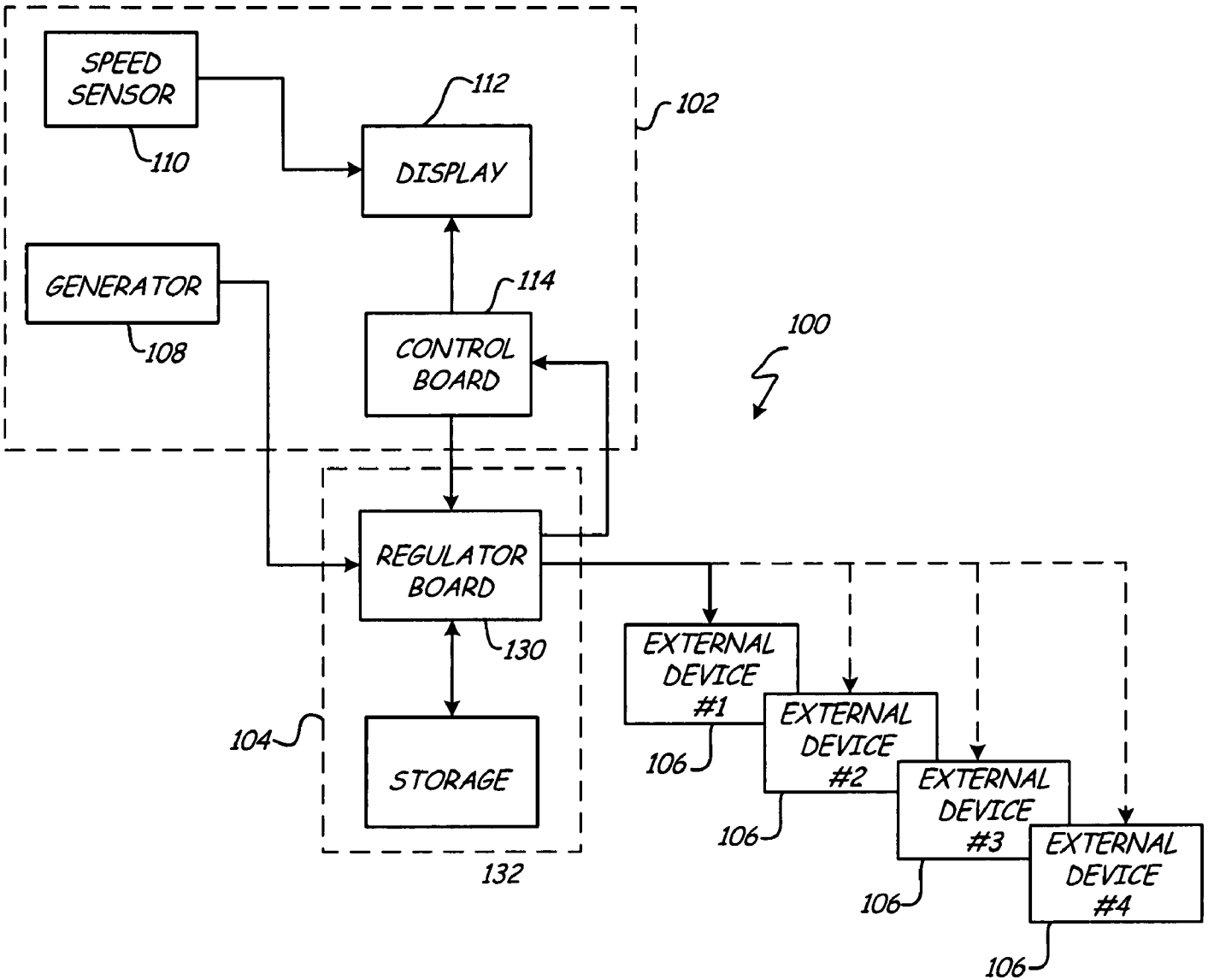
FIG. 1 is a schematic block diagram of an interactive activity system.

In one aspect of the present invention power is generated within an interactive environment. In one embodiment, the interactive environment is a playground. However, those skilled in the art will appreciate that the interactive environment could be any place of public congregation including any amusement, leisure, or educational environment. Examples of applicable environments include, but are not limited to, a supermarket, a classroom, a physical education station, health clubs or a science museum.

Power generation within the interactive environment illustratively occurs in association with a powered play system. The powered play system includes at least one generator. In one embodiment, the generator is a human-powered device configured to translate human physical activity (e.g., jumping, swinging, running, biking, swimming, etc.) into collectable electrical power. In another embodiment, the generator is a human-powered playground apparatus (e.g., a merry-go-round, a swing, or any other common or contrived device) configured to translate human physical activity into collectable electrical power. In still other embodiments, any type of generator (human-powered or not) can be incorporated (e.g., substituted or added) into the system to facilitate the production of collectable electrical power. Appropriate non-human-powered generators include, but are not limited to, wind powered and solar powered generators.

In one embodiment, the powered play system also includes a storage component for receiving and storing electrical power received from the generator. In another embodiment, the powered play system also includes one or more applications to which at least a portion of the power stored in the storage component is distributed. Those skilled in the art will appreciate that the stored electrical power can be maintained in accordance with applicable system requirements or restrictions. For example, the electrical power distributed to a given application provides the necessary voltage of electricity in accordance with applicable application requirements.

In one embodiment, the powered play system is implemented as an extensible product family. For example, the system can be configured to facilitate the addition or removal of generators, applications and/or storage devices at the discretion of an owner or operator of the interactive environment. Generators, applications and/or storage devices can be sold separately or together with other components as part of a package. As an example of the described extensibility, following an initial purchase of a generator, application and storage device, an owner or operator might choose to acquire and implement additional power-receiving applications that draw power from the already purchased storage device, which stores power received from the already purchased generator. Of course, generators and power storage components can also be added or replaced as needed or desired to support system requirements or limitations.

In one embodiment, at least one generator in the described powered play system is a user-powered device configured such that, when a user interacts with the device, there is a generation of electrical power. In one embodiment, a portion of the generated electrical power is utilized to activate a display (e.g., a game) associated with the user-powered device. At least a portion of the power generated beyond that used by the display is stored for subsequent distribution to separate application devices within the powered play system (e.g., lights or games that may or may not be sold as add-on products).

In one embodiment, a user-powered generator incorporated into the powered play system has a cycle appearance and includes bicycle-style pedals. The generator is configured such that power is generated when the user interacts by pedaling. A portion of the generated power is illustratively utilized to power a game presented on an associated display, which, in one embodiment, is implemented to have an appearance at least similar to a motorcycle dashboard. In one embodiment, the dashboard display includes a simulation of a racetrack (e.g., a series of LED's), wherein a series of lights move around the track at a pace that is representative of the speed at which the user is pedaling.

In another embodiment, the dashboard display includes additional lights, which may be in the form of LED's, indicative of additional features. For example, lights may be utilized to indicate an elapsed time, an approximate land speed (e.g., miles per hour) estimated based on pedal speed, a number of laps completed and/or remaining, or an amount of energy stored (e.g., a fuel gauge indicating how much energy is stored on-site for distribution).

In accordance with yet another aspect of the present invention, the dashboard display is configured to facilitate a game that may be played by any number of users. For example, a user may compete against his/herself (e.g., to see how fast or how long they can pedal). Alternatively, a plurality of users can compete simultaneously, or by taking turns and comparing results. In one embodiment, a number of cycles may be configured for cooperative interaction such that a number of users using separate cycles are encouraged to compete against each other on a real-time basis. The dashboard display may be configured to show the real time status of other users.

In one embodiment, records are kept such that a user using the cycle can compete to establish a personal best (e.g. maximum speed or most laps competed), or can compete against the personal best of other users. In another embodiment, the cycle is configured to allow for a user to input log-in information that is utilized to retrieve a stored record. Thus, an input mechanism may be implemented (e.g., associated with a system display component) into the system to enable a user to input user information such as, but not limited to, age, user-id, etc. Examples of log-in information include, but are not limited to, user names, passwords, or PIN numbers. The log-in information can be used for any purpose including, but not limited to, record keeping and retrieval. In one embodiment, log-in information can be utilized to retrieve and implement a set of operation characteristics (pedal resistance, etc.). In one embodiment, a display device that is separate from the generator display (e.g., a display kiosk displaced from the cycle) is incorporated into the system to facilitate a display or interaction functionality, such as, but not limited to, any function described herein as being attributable to the generator display (log-in, record retrieval, etc.).

Still further, in one embodiment, the standard for evaluating performance criteria (such as lap count and/or maximum speed) may be adjusted based on the age or abilities of a given user. For example, the cycle can be configured to allow for the input of the age of a user thus extending (or reducing) the time or speed required to complete a lap. In this manner, young users are given a proportional incentive, in accordance with a goal of promoting enjoyable physical activity. A younger participant may be able to complete shorter laps leading to less frustration and greater enjoyment.

FIG. 1 is a schematic block diagram of an interactive activity system 100 in accordance with one aspect of the present invention. System 100 is an example of, as has been described, a power play system to be implemented within an interactive environment. System 100 includes at least one power generation sub-system 102, at least one electrical power storage system 104, and at least one external device 106.

Figure 2:
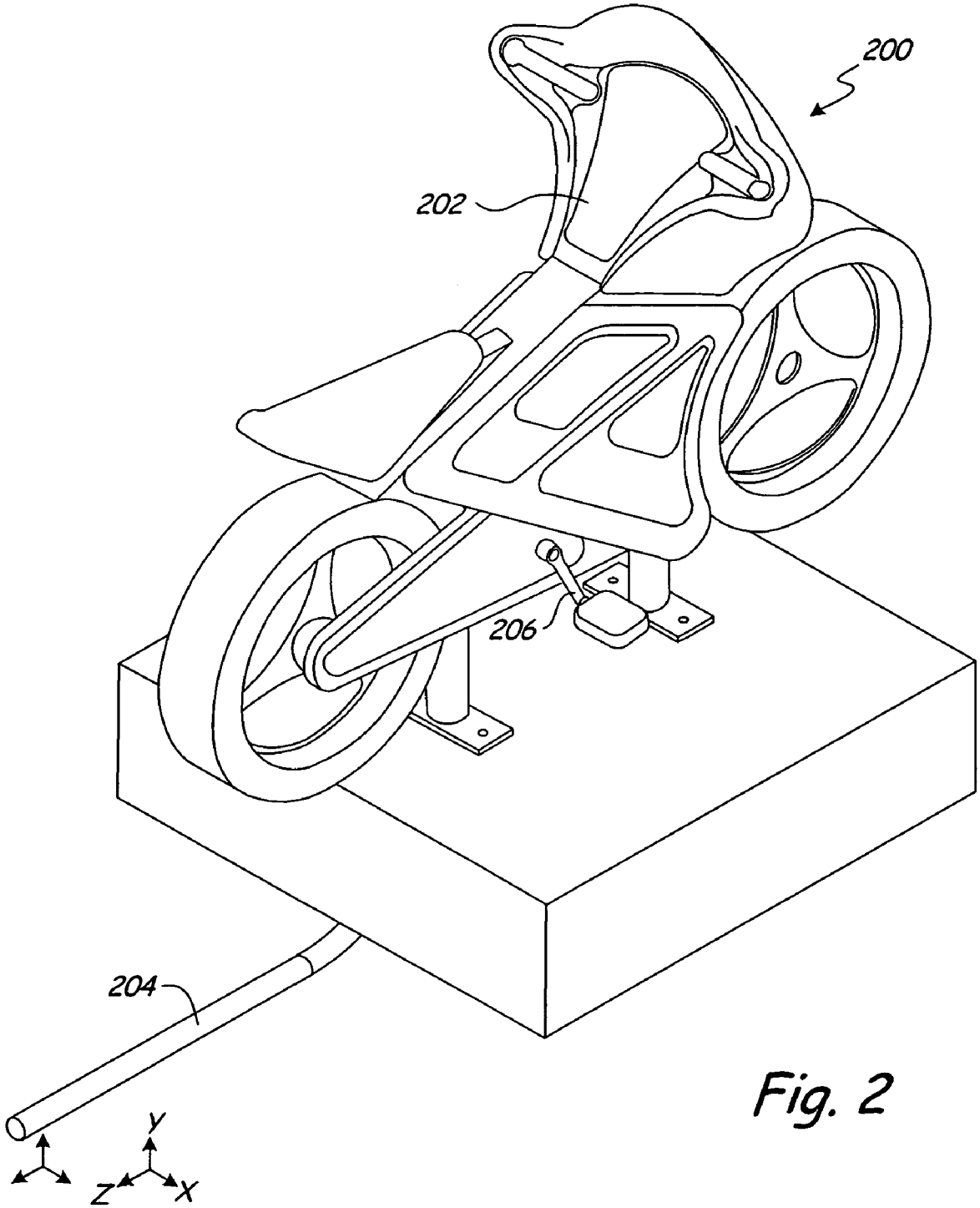
FIG. 2 is a perspective view of a generator.
Figure 3:
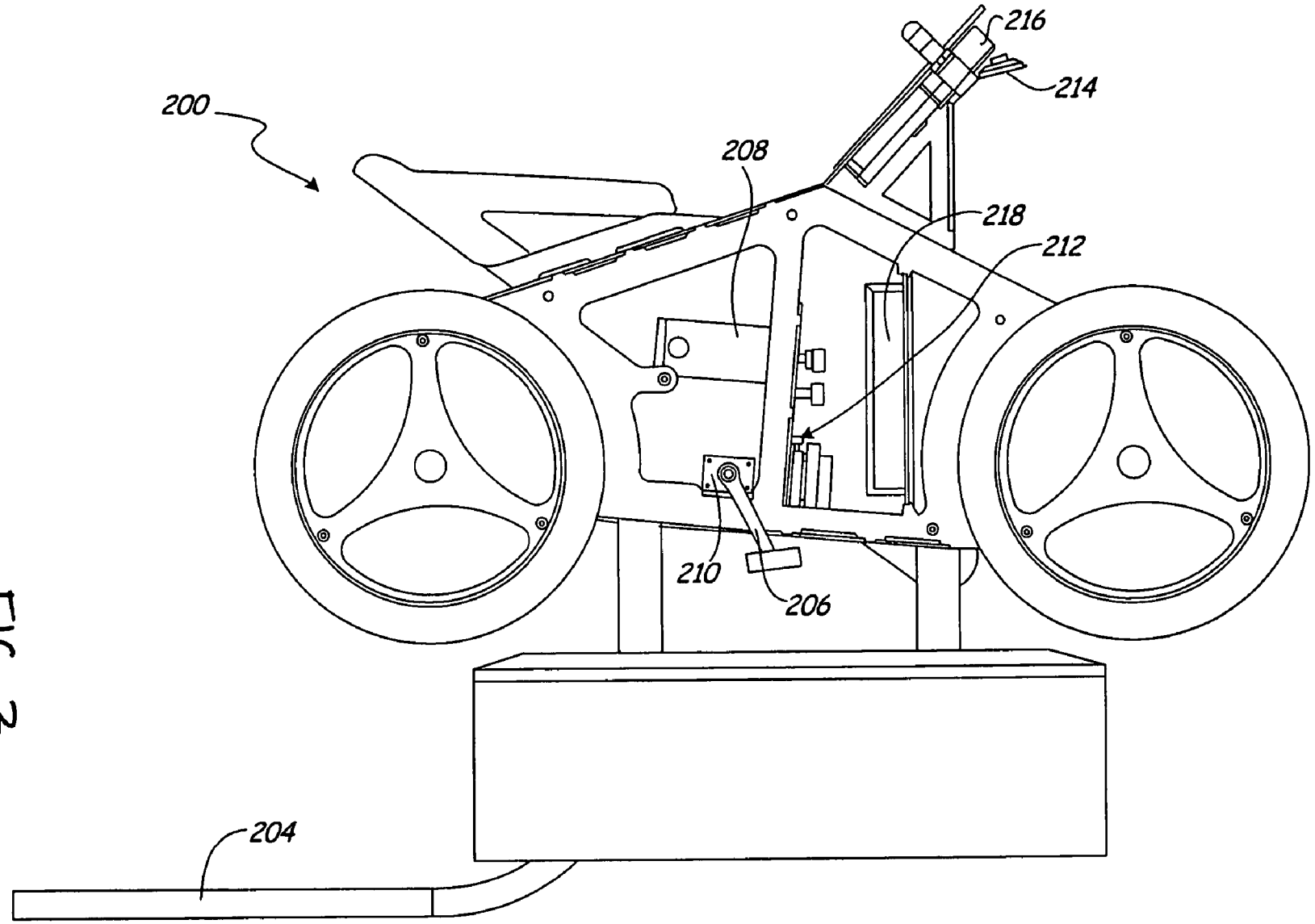
FIG. 3 is a side view of the generator.

Sub-system 102 includes a generator 108. In fact, generator 108 may be a plurality of generators. The generators may be user-powered, wind-powered, solar-powered, or otherwise powered. In one embodiment, generator 108 is an interactive device that generates electrical power in response to physical inputs received from a user. FIGS. 2 and 3 are illustrations of one embodiment of a generator 108 in the form of a device 200 having a motorcycle or bicycle appearance. By pedaling the cycle device 200, a user generates electrical power.

Electrical power generated by generator 108 is transferred to a regulator board 130. The electrical power is eventually transferred to an electrical storage mechanism 132. Storage mechanism 132 comprises means for storing power generated by generator 108. Examples of appropriate storage devices include, but are not limited to, any type of capacitor or a rechargeable battery such as a nickel metal hydride (NiMH) battery, a nickel cadmium (NiCd) battery, a lithium ion (Li-Ion) battery, a sealed lead acid (SLA) battery, or any other suitable battery. However, it is important to note that any other suitable means for storing power may be utilized without departing from the scope of the present invention.

At least when sub-system 102 includes a user-powered generator, the system may also include a visual display 112. In one embodiment, display 112 is utilized to encourage a user's desire to interact with generator 108 so as to produce more electrical power. In another embodiment, the output on display 112 is configured to incorporate information derived from a speed sensor 110.

FIGS. 2 and 3 are perspective and side views of one example of a user-powered generator 200. As has been described, the generator is configured to generate power through user interaction. In one embodiment, power is generated by the user through interaction with pedals 206. Pedals 206 are functionally connected to generator unit 208 which is configured to generate power that is illustratively transferred through connector 204 to a storage sub-system (i.e., sub-system 104 in FIG. 1). In accordance with one aspect of the present invention, a display 202 is powered using electrical power generated through interaction of the user with cycle 200. Alternatively, display 202 can be separately powered. For example, power utilized to operate display 202 can originate from a source other than generator 202. Of course, the display could be powered in any manner without departing from the scope of the present invention.

In one embodiment, cycle 200 includes a gear system functionally engaged to pedals 206. In one example, a gearbox 210 is provided for increasing or decreasing the user generated force required to operate cycle 200 (e.g., the force required to move pedals 206). The system may or may not support direct gear adjustments by the user (if so, the display may include an indication of current gear). In one embodiment, the system is configured to automatically make gear adjustments based on user inputs (e.g., based on age, desired pace, etc.).

In accordance with another embodiment, cycle 200 comprises a speed sensor 212 that is functionally connected to pedals 206. Speed sensor 212 can be configured to support any of a variety of system functions. In one example, speed sensor 212 generates a signal based on a pedal speed, a signal that is utilized for applications such as interactive displays or games.

In accordance with yet another aspect of the present invention, an external device such as speaker 214 is mounted on cycle 200. In one embodiment, speaker 214 is configured to produce sounds corresponding to applications utilized in conjunction with cycle 200 (e.g., sounds in conjunction with display 202). In one example, speaker 214 is used to produce motorcycle or race-related noises.

Figure 4:
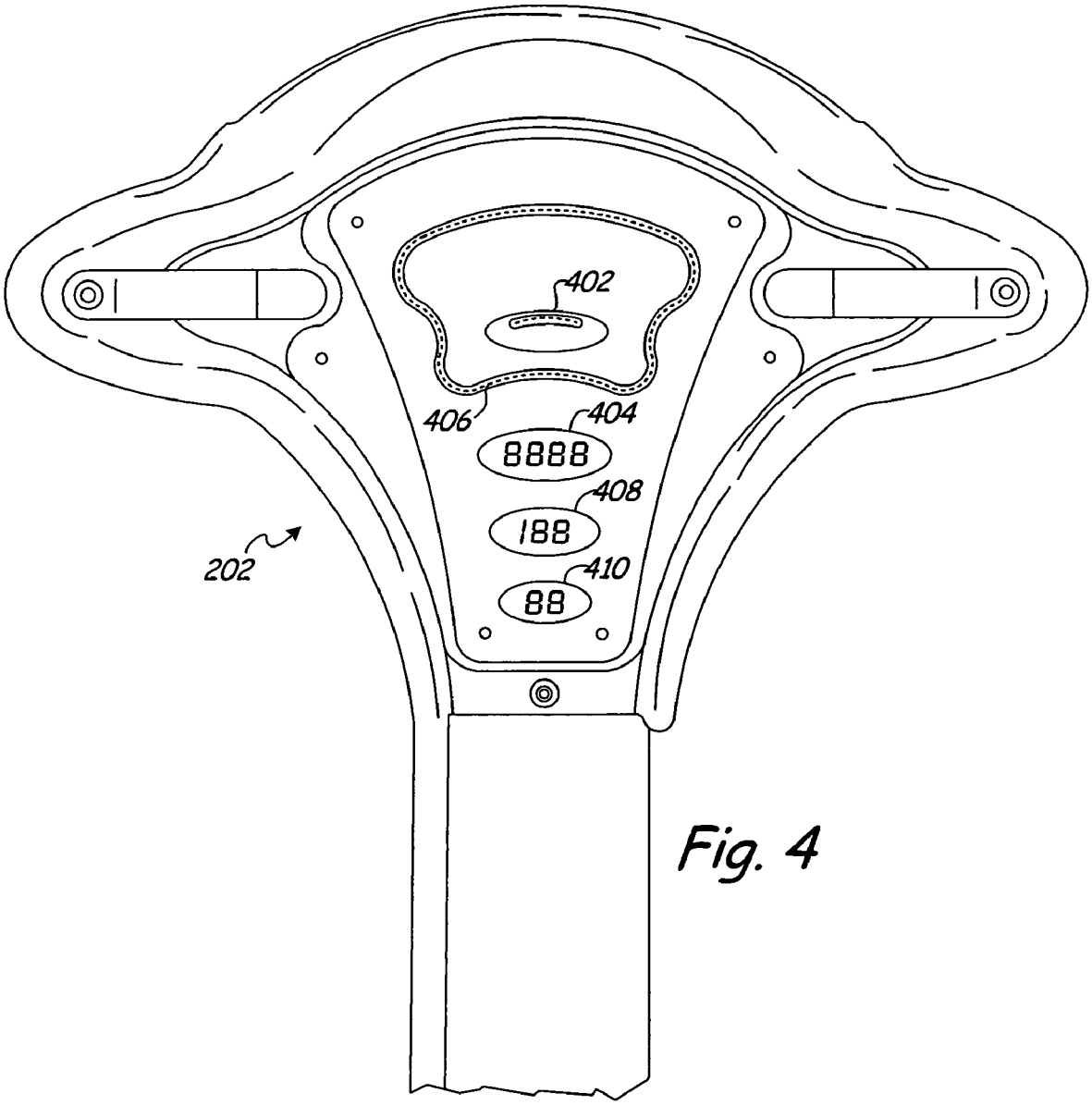
FIG. 4 is a front view of a display associated with the generator.

In the context of cycle 200, an example display is shown in FIGS. 2 and 4 as item number 202. FIG. 4 is a close-up view of display 202. Display 202 includes a lap monitor 406 having lights that are presented in sequence to show a rider's progress in completing a lap. Lap counter 410 records the number of laps a rider has completed. In one embodiment, the lap counter tracks the laps a rider has remaining. Time readout 404 shows the amount of time it takes or has taken to complete a lap. Alternatively, time readout 404 may show an amount of time that has lapsed since the rider began pedaling. In yet another configuration, time readout 404 shows an amount time that the rider has remaining in order to complete the lap within a predetermined amount of time.

Display component 408 provides an approximation of how fast the rider is traveling (e.g., on a hypothetical basis). In one embodiment, a speed sensor 110 provides an input to display 112 to assist in providing a speed output through visual component 408. In some embodiments, speed sensor 110 is the same or substantially similar to speed sensor 212 described in relation to FIG. 3. Collectively, the components of display 202 encourage a rider to keep pedaling and produce more electrical power to be stored, for example in a storage component 132 as shown in FIG. 1.

In accordance with another aspect of the present invention, electronic assemblies 216 and 218 are provided. In one embodiment, assemblies 216 and 218 provide control functions to support cycle operation, including display operation. In one embodiment, the electronic assemblies are configured to facilitate any control function related to the production, storage or distribution of power as described. In one example, the assemblies are configured to compute lap, speed, and time information. In another example, the assemblies are configured to record, display, retrieve, and/or store log-in and other associated user data. In yet another example, the assemblies are configured to control the operation of the gear and generation-encouragement systems. It is important to note that, in addition to embodiments described herein, assemblies 216 and 218 can be utilized for any other electronic or control-related purpose without departing from the scope of the present invention. The illustrated electronics assemblies, generation component 108, and display component 202 are, to be sure, only examples of many potential implementations.

As is illustrated in FIG. 1, the functionality of the display is implemented in association with a control board 114. For complex applications, a more complete computer system can be implemented to manage display functionality. In accordance with one embodiment, control system 114 is also connected to a regulator 130. In accordance with one embodiment, the display on the user-powered generator includes an indication of the amount of electrical power stored in storage mechanism 132. In another embodiment, a display located away from the generator, elsewhere in the interactive environment indicates the amount of electrical power stored in storage mechanism 132. In one embodiment, a user that is operating or has operated the user-powered generator can see how much power is stored in mechanism 132 and can monitor changes in the amount of power stored.

In one example, the user is encouraged to exert more physical output (e.g., pedal faster) based on the display indicating the amount of stored power. For example, the user can be encouraged to increase or maximize the stored electrical power. Control board 114 is illustratively configured to receive that type of information from the regulator board 130, which illustratively monitors the status of storage component 132.

In accordance with another embodiment of the present invention, the power generated through sub-system 102, and stored in sub-system 104, is utilized to power one or more external devices 106. In one embodiment, each device 106 is functionally engaged to an electrical connector that is functionally associated with storage mechanism 132. Thus, a plurality of connectors provide support for the distribution of power from the storage mechanism to the external devices. Devices 106 are illustratively powered interactive applications. In one embodiment, one external device 106 is a light. In a further embodiment, the light is implemented as part of a display intended to encourage user interaction. In one example, the light may be used for purposes of a game such as a chase the light or "simon-says" game. A simon-says game, in one embodiment, is a game wherein a pattern is presented to the user (e.g., a pattern of lights or sounds) and then the user is tasked to press inputs so as to repeat the same pattern (pattern becomes progressively complex as the user continues to accurately repeat the pattern).

In yet another embodiment, an application 106 is implemented wherein a series of lights are powered around an area proximate an associated generation device. Each light is generally configured to light for a short period of time. The lights may be configured to light up in a particular pattern (e.g., consecutive lights are activated one after another) or randomly. The lights are configured to monitor interaction in the form of physical activity. For example, in one embodiment, a light will stay on for a longer period of time if touched. Thus, a game arises as a user chases to catch up with and touch a light while it is on. Other similar games, of course, are also within the scope of the present invention.

In another embodiment, external devices 106 include an interactive game such as mechanical or electrical racing games, video games, or "Simon-says" or "cause and effect" type games in which the user interacts by pushing or touching buttons.

In another embodiment, external devices 106 include a fan, such as a fan positioned on or in proximity to generator 108. In one embodiment, the fan is utilized to blow air towards the user of a user-powered generator. Alternatively, the fan can be positioned a distance away from the generator somewhere else in the interactive environment.

In another embodiment, external devices 106 include a treadmill. In still another embodiment, external devices 106 include a camera configured to take pictures and/or movies. In one example, the camera is mounted to take pictures of a user interacting with a generation device.

In another embodiment, external devices 106 include a laser tag system. In one example, the laser tag system is utilized within or proximate to the same interactive environment as corresponding generation components. Alternatively, the laser tag devices may be off-site (i.e., away from the interactive environment). In still another embodiment, received power is utilized to operate a balloon mechanism 106. In one example, received power is used to energize a device for heating the air inside of the balloon, thereby causing it to rise. Alternatively, the generated power can also be used to drive a fan to blow air into the balloon.

In another embodiment, devices 106 include a race track system comprising mechanical cars configured to simulate a car race. For example, the speed of a car in the race may be tied to the magnitude of user input received through a particular generator. The system could be configured such that a plurality of users (e.g., children on a playground) can compete in a race by driving their own generator so as to move a corresponding device 106 in a race.

In another embodiment, external devices 106 include speakers. The speakers may be mounted on a user-powered generator, elsewhere in the interactive environment, or at a location distant from the interactive environment. In another embodiment, the speakers are utilized to produce sounds in conjunction with a user-powered generator. For example, when a cycle-style generator is utilized, the speakers can be configured to produce sounds such as "ready, set, go", "one lap remaining", or "finish line." Further, the speakers may be utilized to produce motorcycle or other race-related noises. Alternatively, the speakers can be configured to produce sounds in conjunction with external devices (e.g., an interactive game) utilized in the interactive environment. Of course, without departing from the scope of the present invention, any sounds within the system could alternatively be produced based on energy from any source other than the stored power.

In another embodiment, an external device 106 is a biofeedback device such as a pulse, blood pressure, or body temperature monitor, configured to provide information to a user. In one embodiment, a display on a user-operated generator is utilized to provide a visual output of the biofeedback information. Alternatively, the display can be separate from the generator (e.g., located elsewhere in the interactive environment, located outside of the interactive environment, etc.).

In another embodiment, external devices 106 include a wireless network connection means, such as a Wireless Fidelity ("WI-FI") service for connecting to the Internet. This communications system is illustratively at least partially powered by the electricity generated through sub-system 102, and stored in sub-system 104. In this manner, an external device can provide a "hotspot" within the interactive environment for computer network access.

The above-mentioned embodiments describing external devices 106 are simply illustrative examples. Any other use of the generated and/or stored power is within the scope of the present invention.

In one embodiment, a system, such as those described above, incorporates a multi-functional power regulation system. For example, power generated by the generator (illustratively a DC power generator) is regulated in three different ways. First, a relatively constant voltage is provided to the main control board to run an application (e.g., the display, an interactive game, an external device) regardless of the charge state of the storage device. Second, power is provided to a charge circuit to charge a power storage device (e.g., a battery, a capacitor) at a maximum current rate. Third, a tractive load is applied to the generator to provide a relatively constant load (e.g., a pedal load). In one embodiment, the tractive load is adjusted (e.g., on an on-going basis) to compensate for the varying load of the charge circuit for the storage device and the varying load requirements for particular applications (e.g., a display, an interactive game, an external device, etc.).

Figure 5:
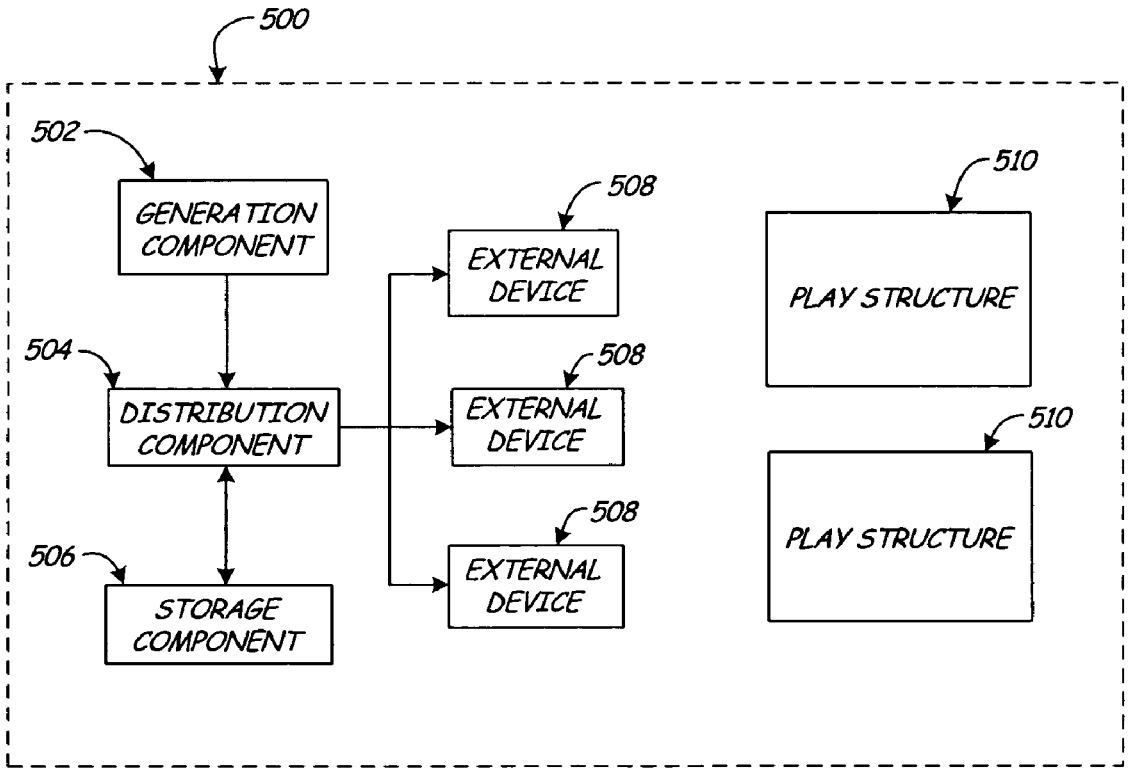
FIG. 5 is a schematic block diagram of an interactive environment.

FIG. 5 is a block diagram illustrating an interactive environment 500 comprising a generation component 502, a distribution component 504, and a storage component 506. Generation component 502 is configured to generate and transfer power to distribution component 504. In one embodiment, generation component 502 is the same as, or substantially similar to, generator 108 illustrated and described in relation to FIG. 1. In one example, generation component 502 is a human-powered generator. In another example, generation component 502 is the same as, or substantially similar to, generator 200 illustrated in FIGS. 2 and 3.

Distribution component 504 is illustratively configured to distribute electrical power to external devices 508. In one embodiment, external devices 508 are the same as, or substantially similar to, external devices 106 illustrated in FIG. 1. However, it is important to note that, as has been described, a broad range of potential different power-receiving external devices is within the scope of the present invention. In one embodiment, distribution component 504 includes a plurality of connectors configured to facilitate the electrical connections necessary to distribute power to the plurality of external devices 508. Those skilled in the art will appreciate that the type of connectors utilized can vary from one application to the next. The present invention is not limited to any one type of connector. Also, the connections could, without departing form the scope of the present invention, be hard-wired.

In accordance with one embodiment, an external device 508 includes an interface configured to facilitate interaction with a user. The interactions can be display-oriented, user-input oriented, or a combination thereof. For example, application 508 may be a game, or a light, or a series of lights that respond to user presence and/or movement. In one embodiment, the purpose of at least one device 508 is functionally related to generation component 502. For example, interactive interface can be a display indicative of a game associated with a display attached to the generator.

In accordance with one embodiment, at least one external device 508 is configured such that a user interacting with generation component 502 (e.g., or with an associated display) cannot effectively interact simultaneously with the device 508. For example, the devices may be displaced from one another so as to be positioned in different locations within the interactive environment 500 (e.g., on different portions of a playground) or facing in different directions.

Storage component 506 is configured to store electrical power. In one embodiment, storage component 506 is the same, or substantially similar to, storage 132 illustrated in FIG. 1. In one example, storage component 506 can be configured to store at least some of the power generated by generation component 502. In one embodiment, power that is not distributed by distribution component 504 is stored in storage component 506. However, in accordance with another embodiment, storage component 506 can be configured to supply power to distribution 504 for subsequent distribution. In this manner, power can be distributed to external devices even when generation component 502 is not currently generating power.

As illustrated in FIG. 5, play area 500 also can include at least one play structure 510. In one embodiment, play structure 510 is a conventional playground apparatus. In one embodiment, structure 510 is a climbing device such as, but not limited to, a jungle gym, monkey bars, a ladder, a walking bridge, chin-up bars, parallel bars, a climbing net, or a climbing pole. In another embodiment, structure 510 is a swingset, a slide, a merry-go-round, a maze, a sandbox, or a see-saw. These are just examples of the many play structures that should be considered within the scope of the present invention.

In one embodiment, play structure 510 comprises at least one elongated member such as, but not limited to, a pipe, beam, cross-bar, a conduit or post. The elongated member can be any support member of structure 510 or, alternatively, could be something other than a support member. In one embodiment, an elongated conductor configured to supply electrical power from storage component 506 (and/or distribution component 504) to an electrical application 508 is at least partially enclosed by at least one of the elongated members associated with the play structure.

In one example, a swing-set play structure incorporates a cross-beam and a support post. The cross-beam (and/or the support post) at least partially encloses the elongated connector that facilitates the transfer of power to an external application. In one embodiment, the elongated conductor includes a conductor encased by an insulator. In another embodiment, the elongated conductor is actually a plurality of elongated conductors.

The elongated conductor need not necessarily travel through a play structured within the interactive environment. In one embodiment, the conductor is buried (e.g., strung through one or more buried conduits).

Each of FIGS. 6, 7, 8 and 9 is a circuit diagram representing a circuit board for supporting portions of an interactive system as described above in relation to FIGS. 2-4.

Figure 6B:
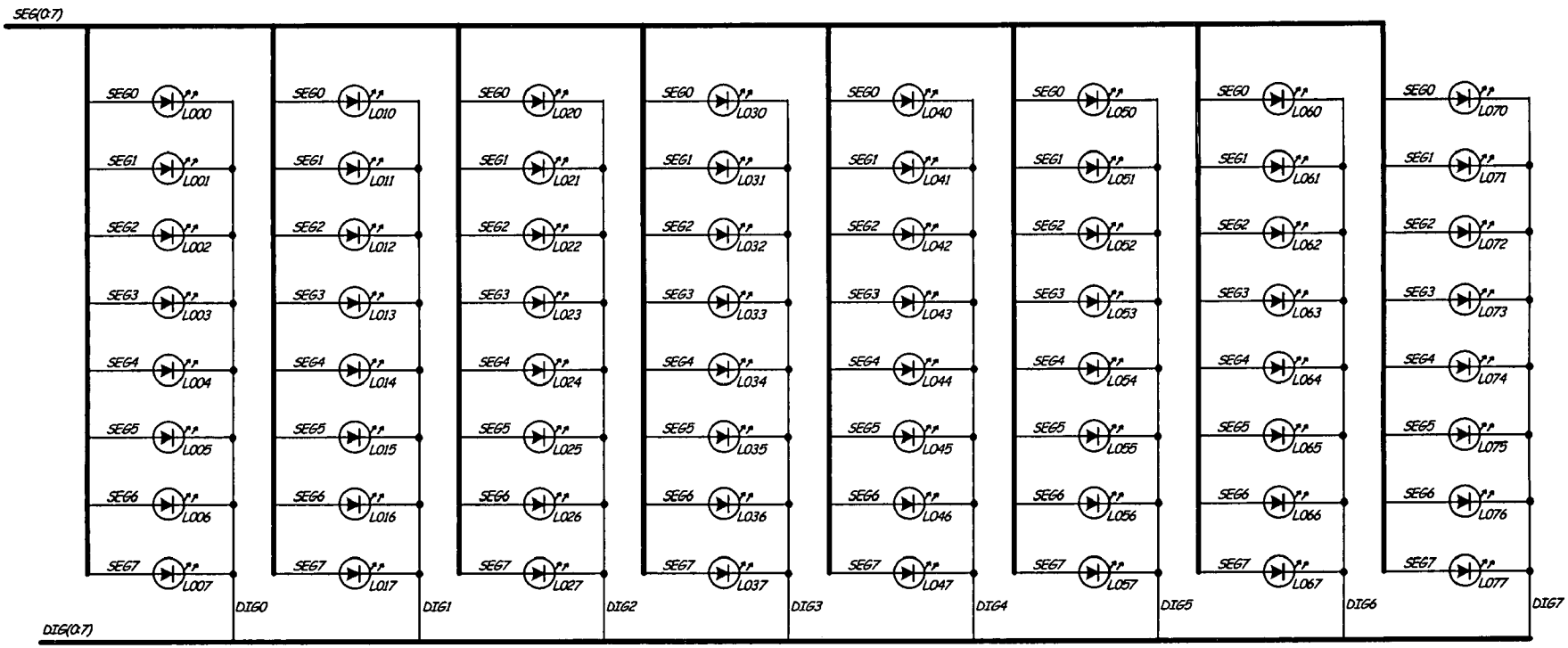
Figure 6C:
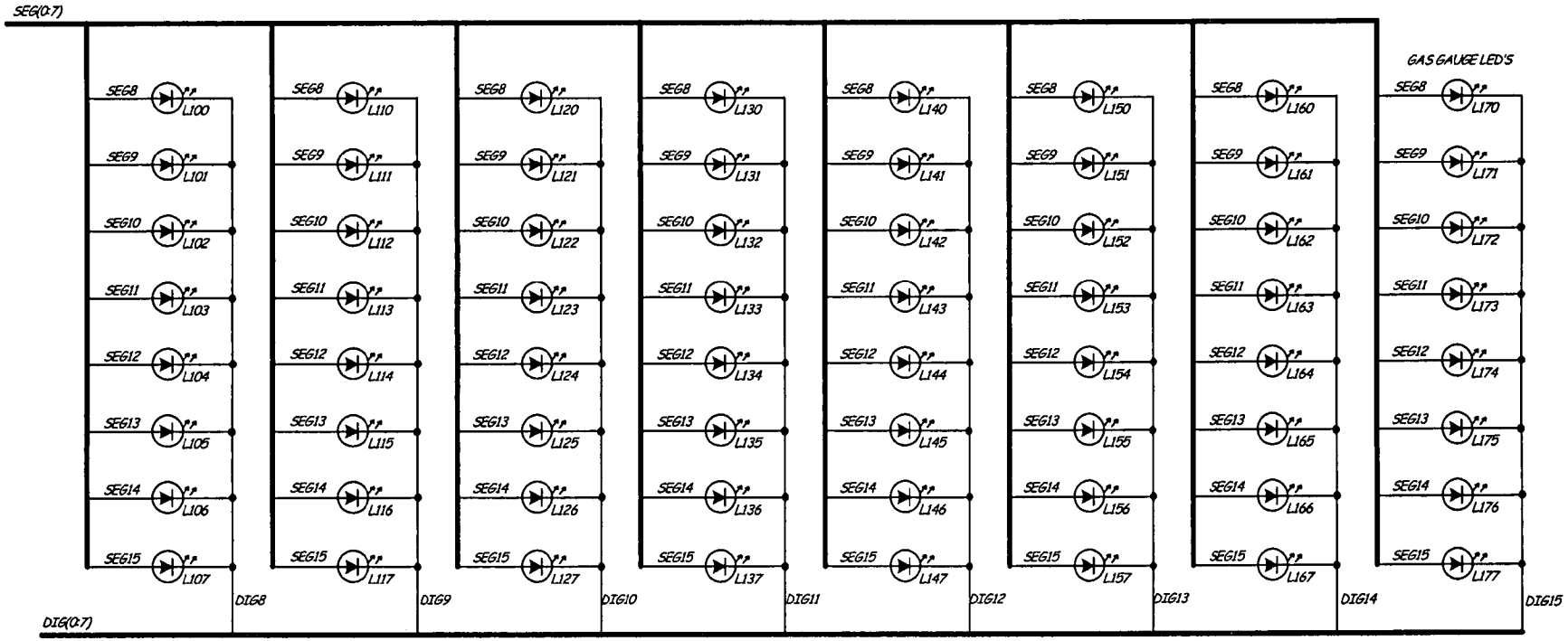

FIGS. 6A-6C illustrate a display-oriented circuit for supporting a portion of the dashboard display. In one embodiment, the circuit shown in FIG. 6 supports elements 402 and 406 described in relation to FIG. 4.

Figure 7A:
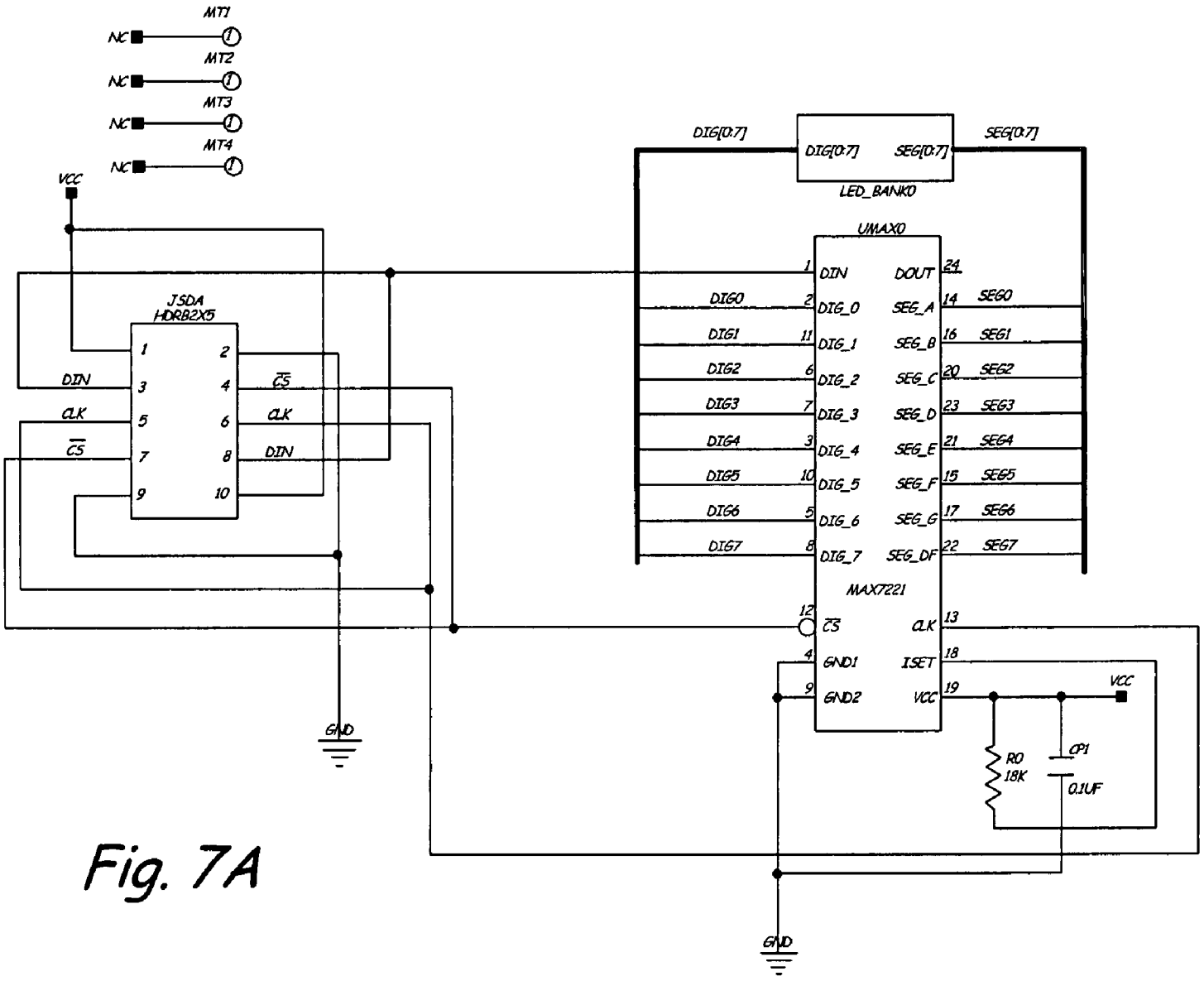
FIGS. 7A and 7B are technical diagrams demonstrating circuitry associated with the display.
Figure 7B:
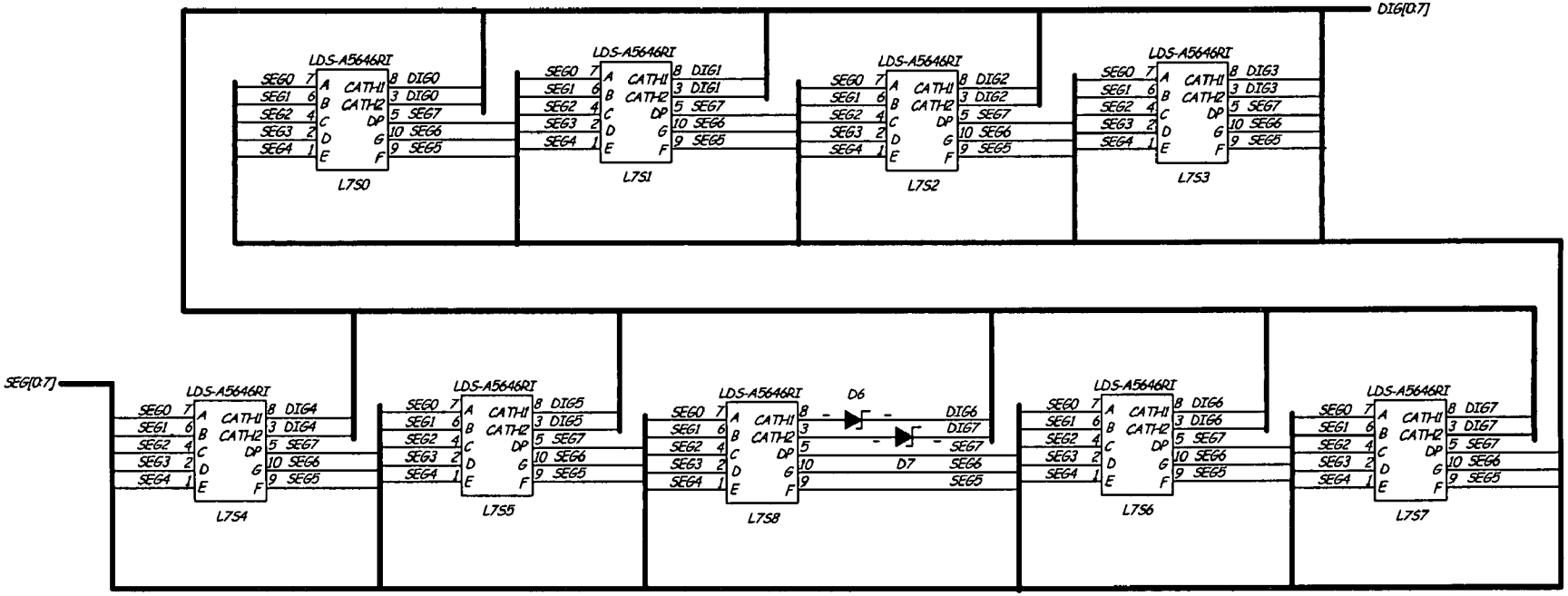
Figure 8A:
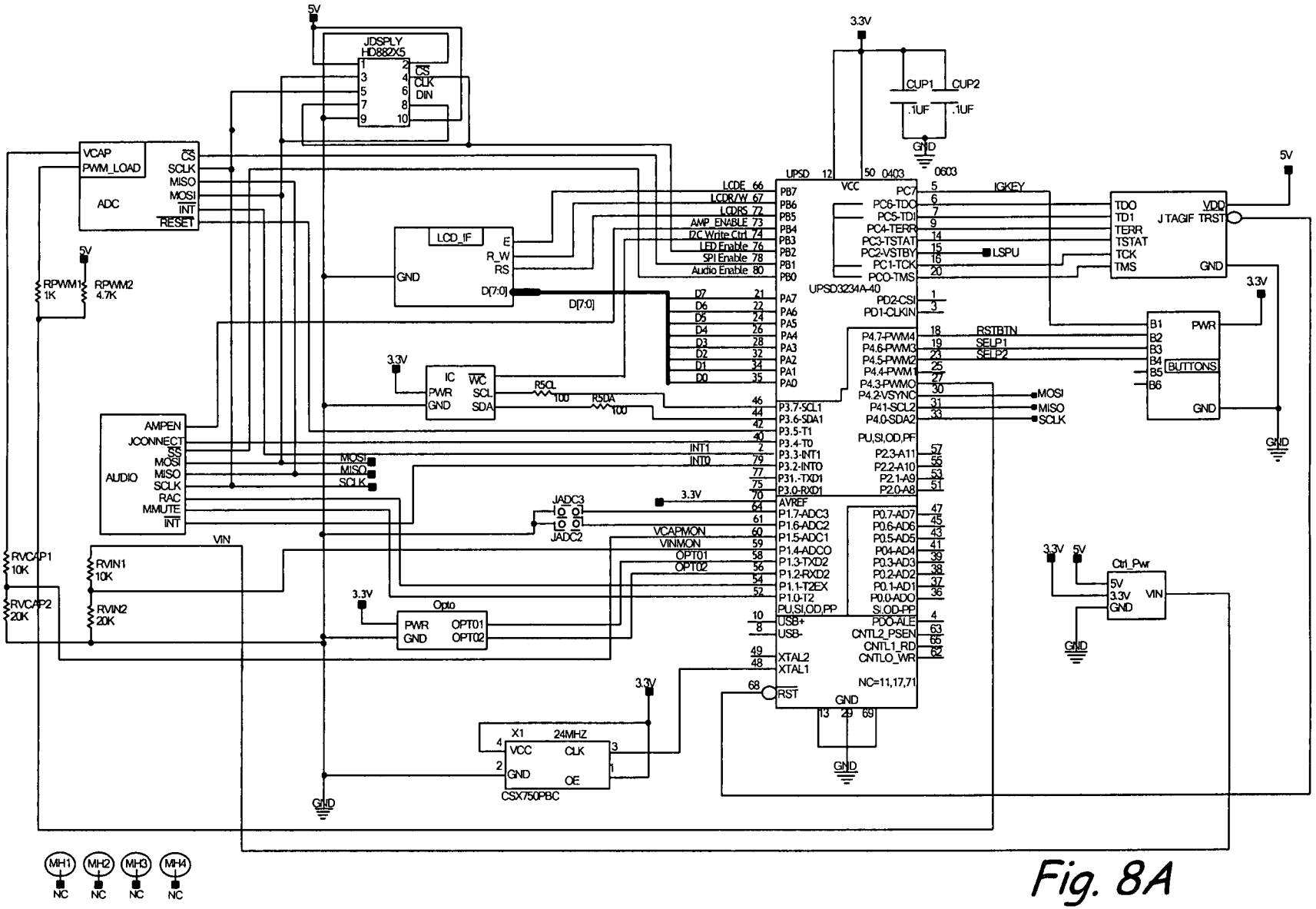
FIGS. 8A-8I are technical diagrams demonstrating other system circuitry.
Figure 8B:
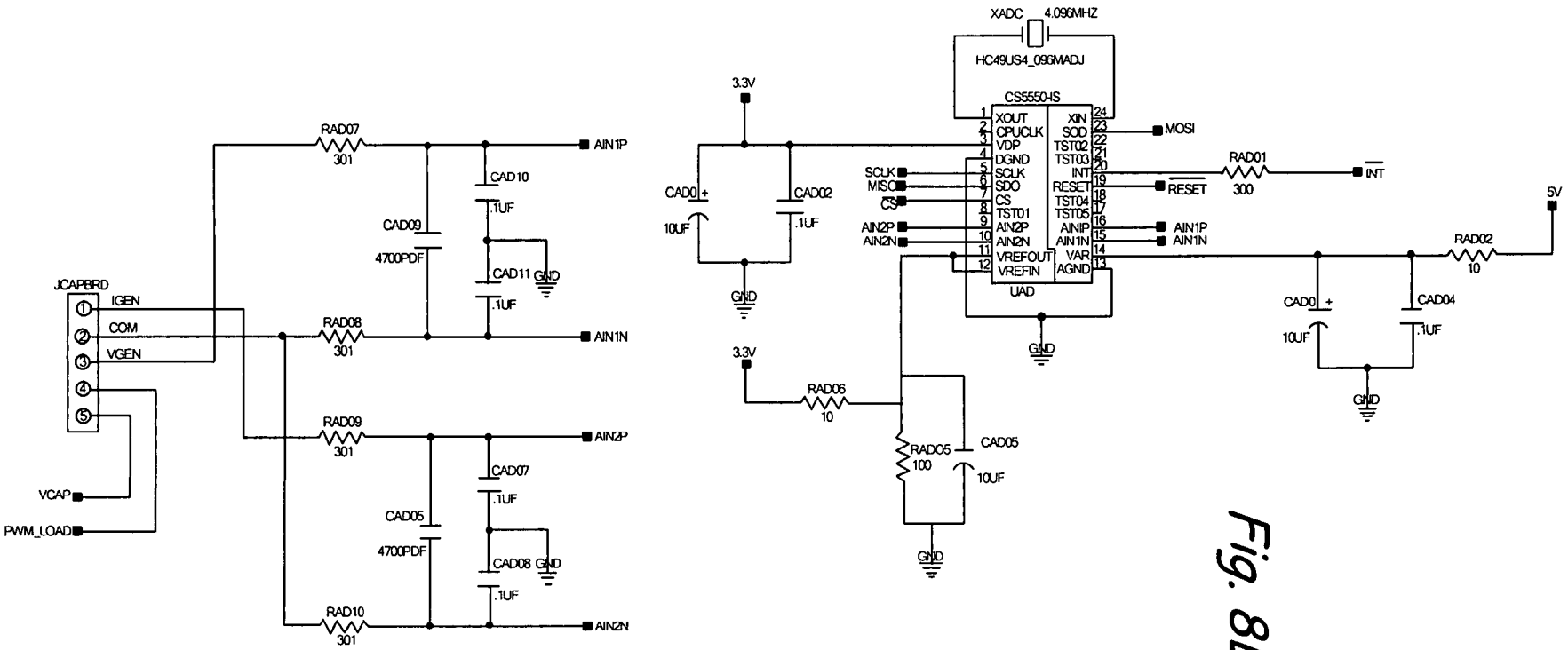
Figure 8C:
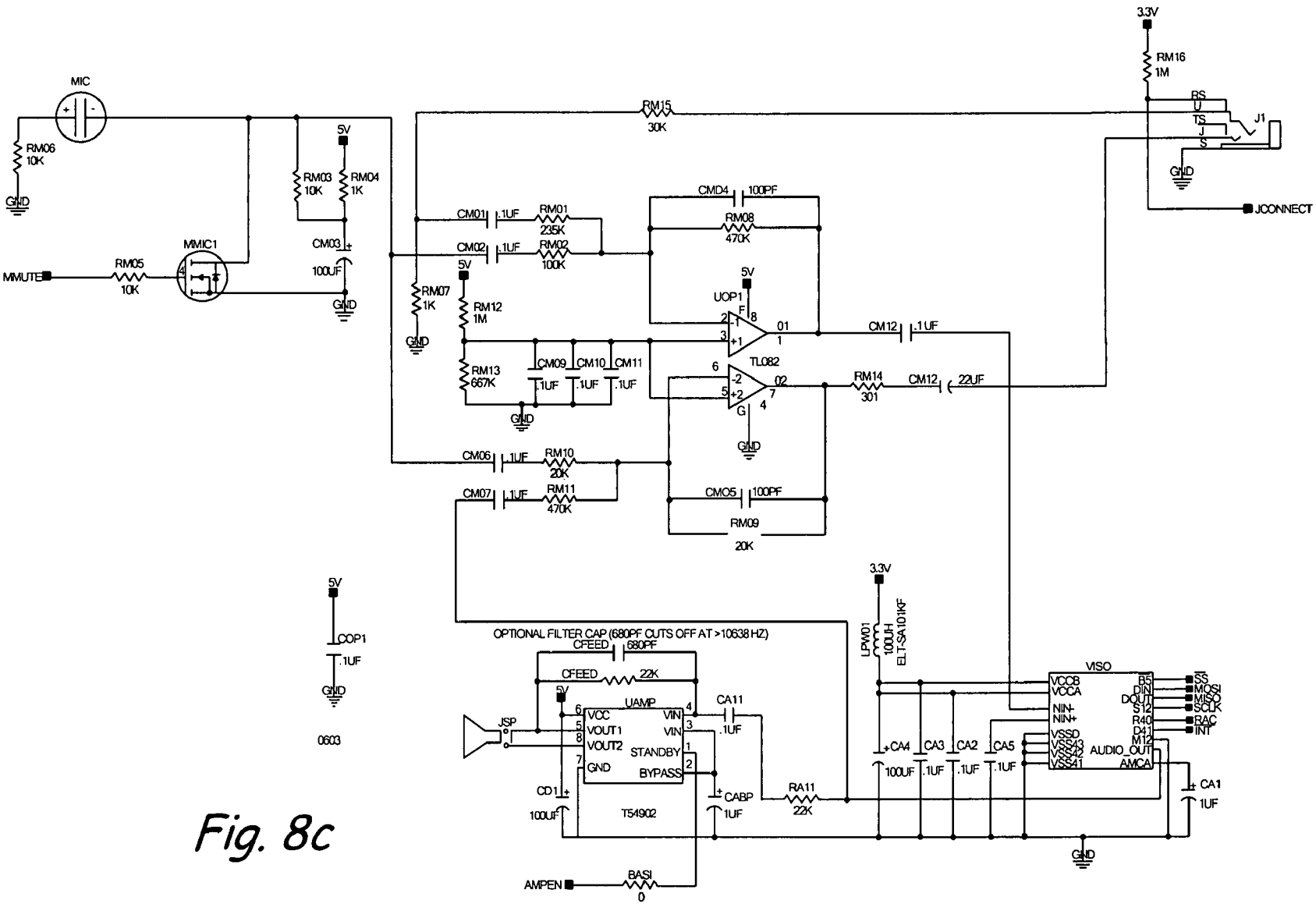
Figure 8D:
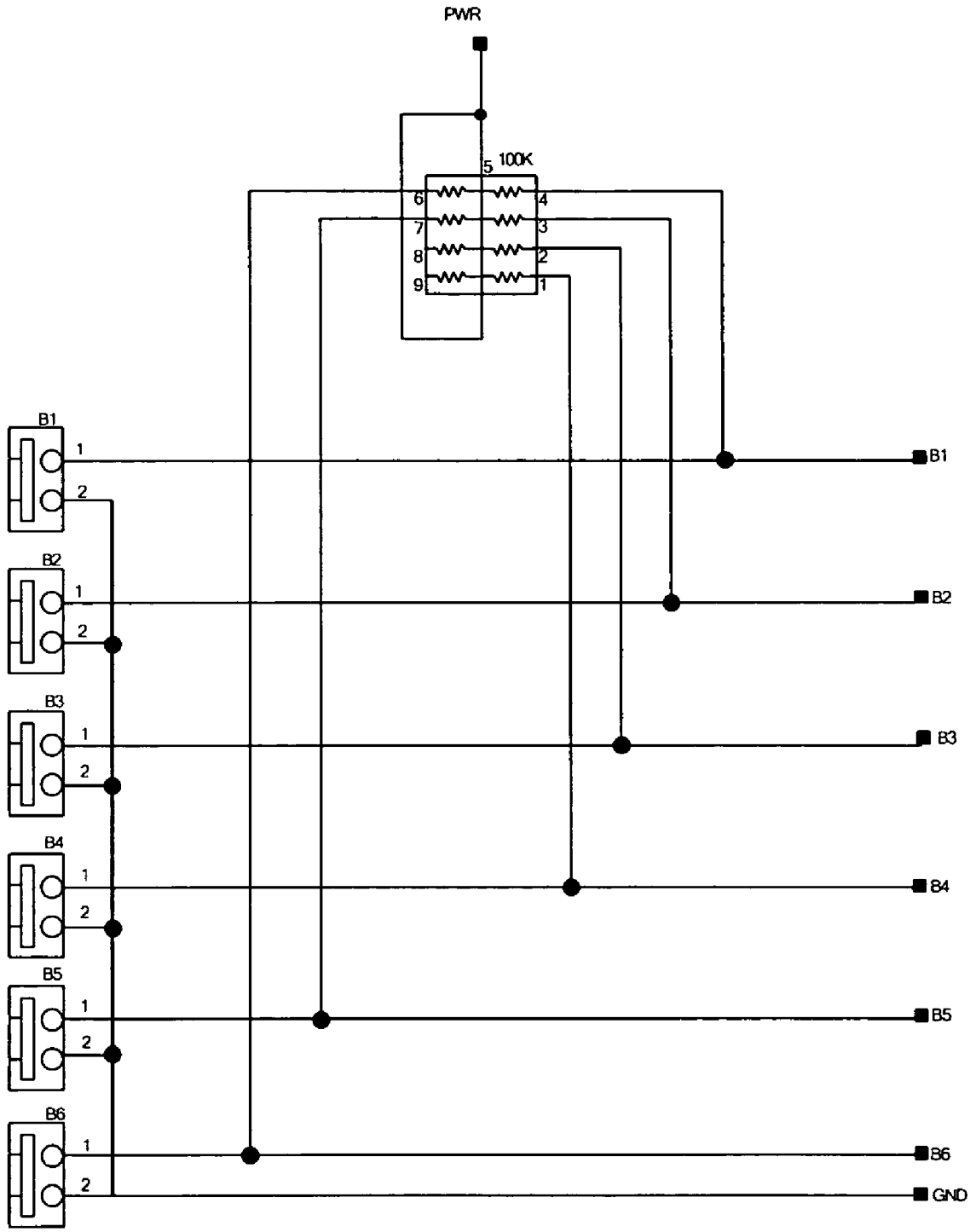
Figure 8E:
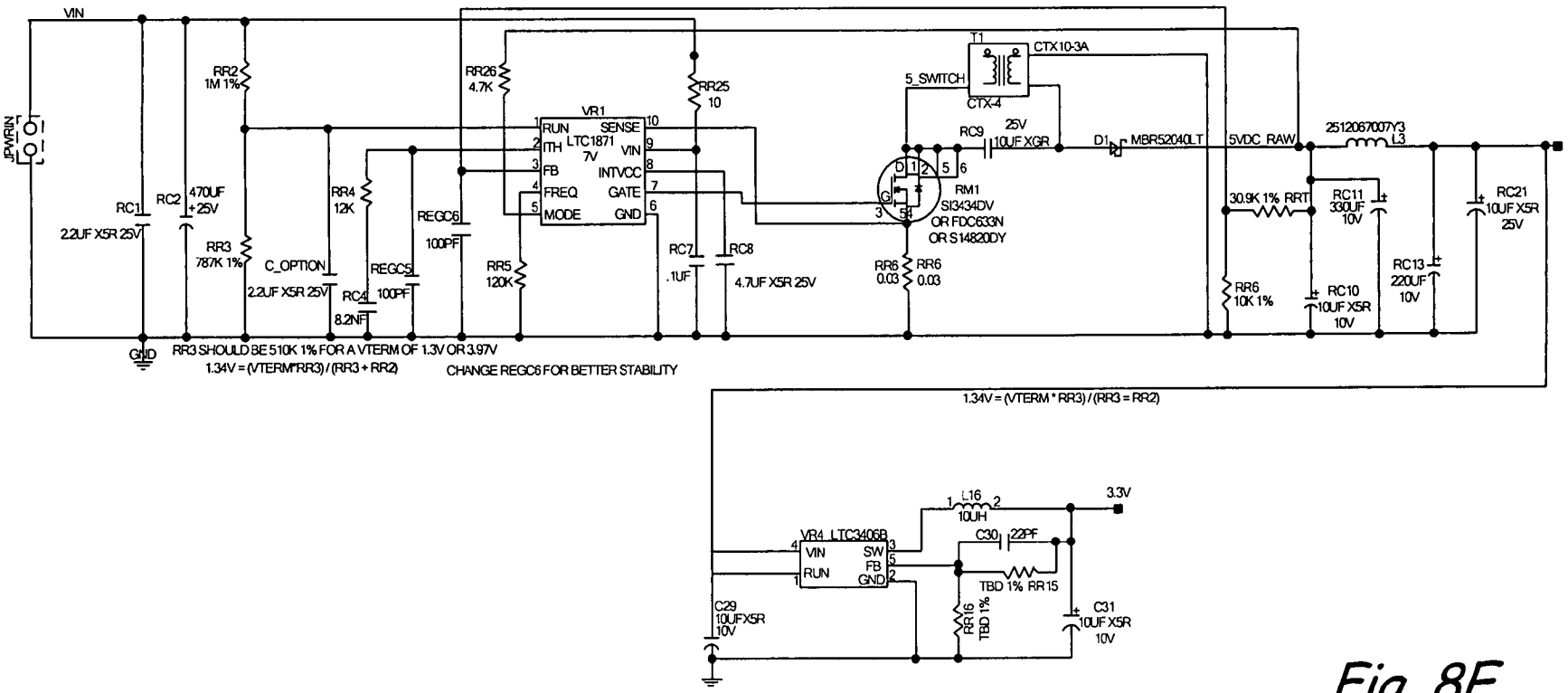
Figure 8F:
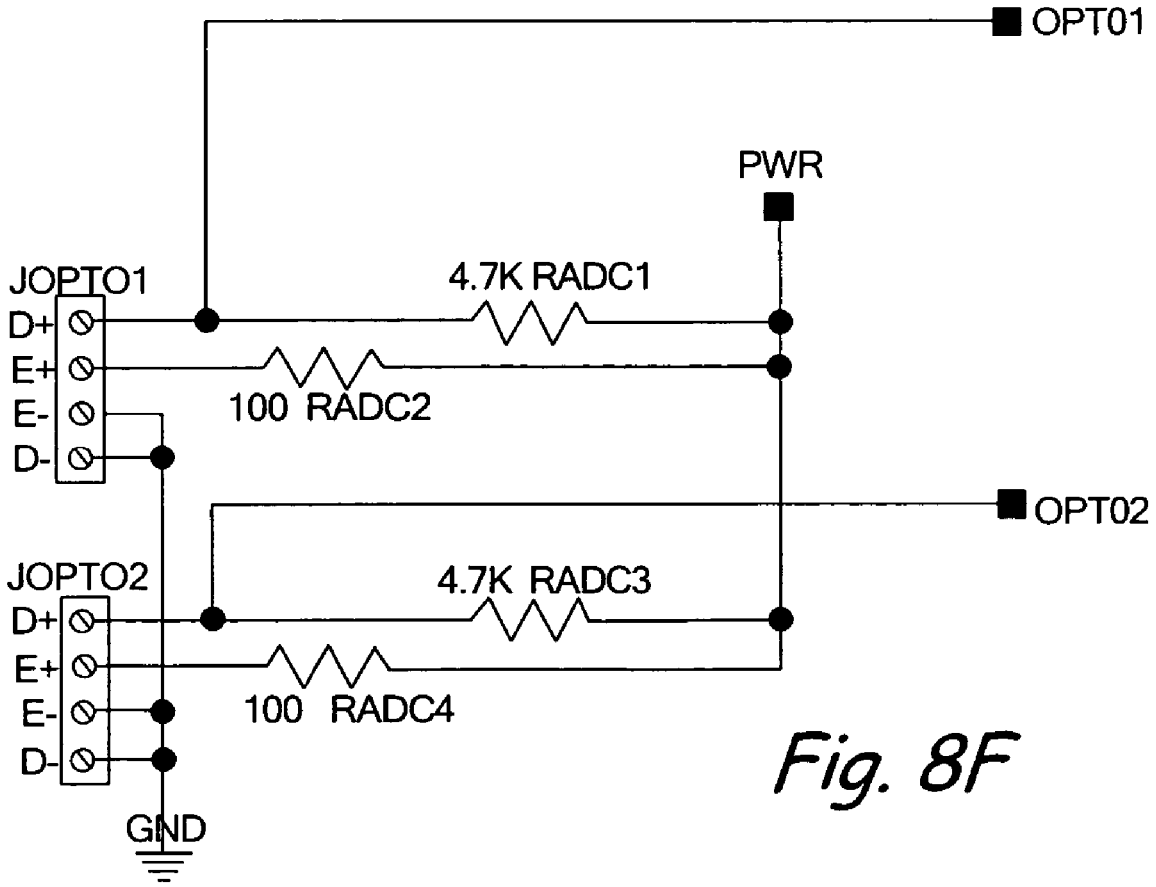
Figure 8G:
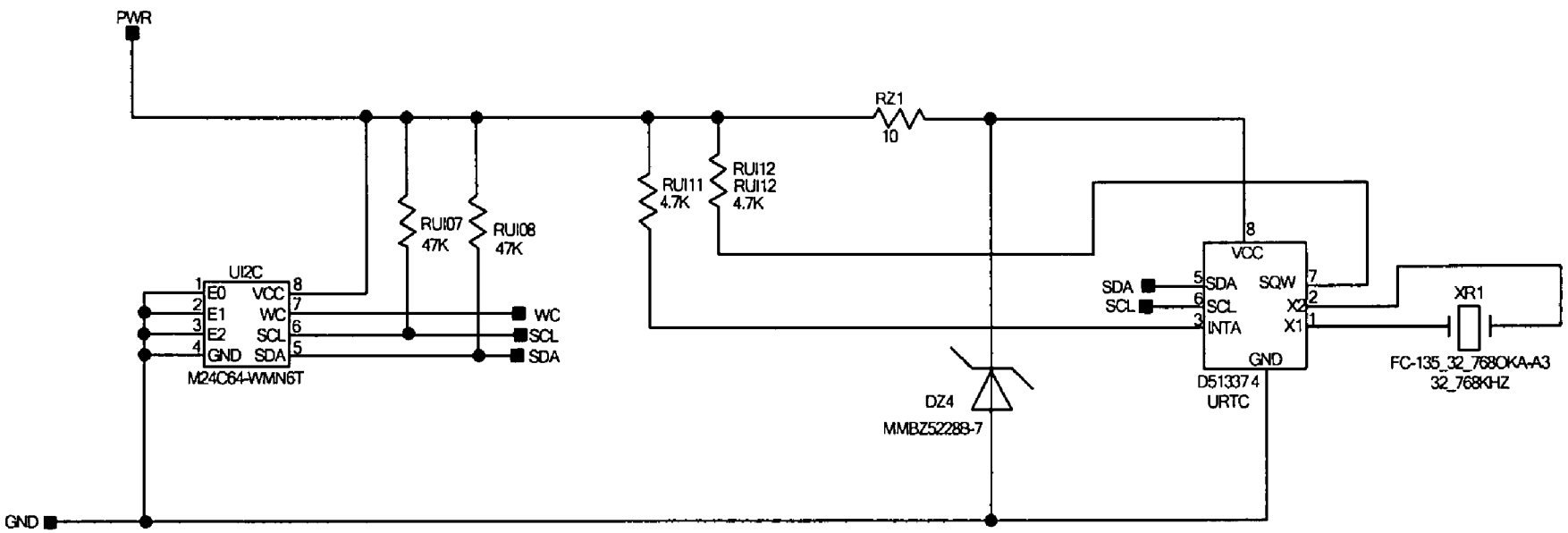
Figure 8H:
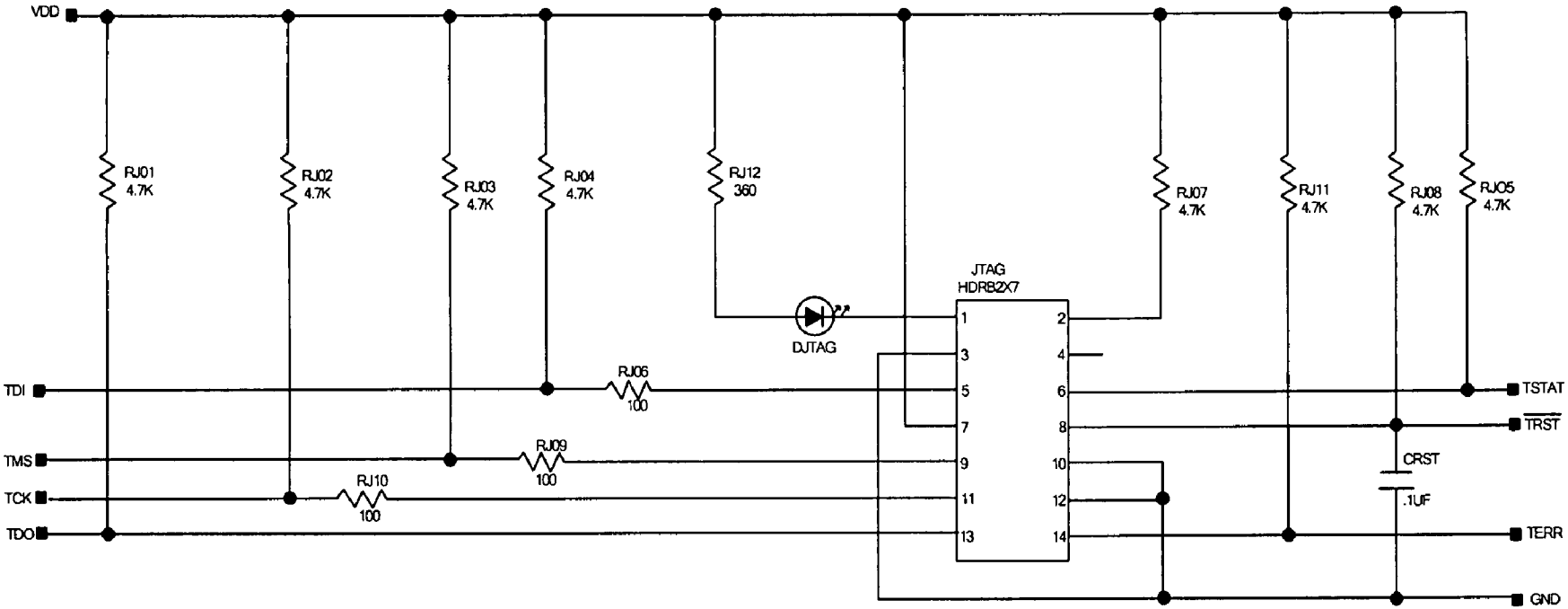
Figure 8I:
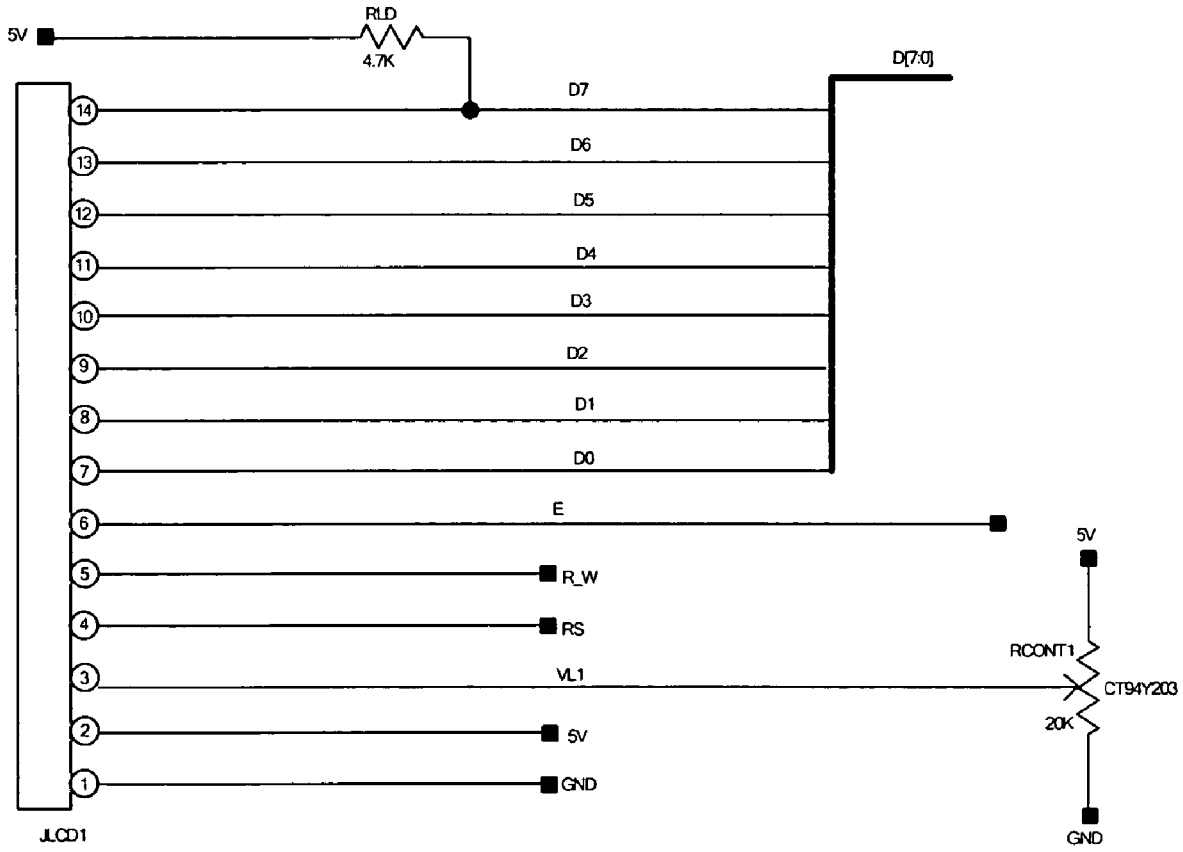

FIGS. 7A and 7B illustrate a display-oriented circuit for providing digital readouts. In one embodiment, this circuit is utilized in the context of digital display readouts 404, 408, and 410 described in relation to FIG. 4.

FIGS. 8A-8I illustrate circuits for supporting other various components. For example, the FIG. 8 circuit illustratively includes functionality for supporting a race game implemented in the context of the dashboard display. In addition, the FIG. 8 circuit illustratively includes sound components for supporting a sound system associated with the cycler (e.g., supports sounds heard by the user). The sound circuit drives an audio input to one or more speakers. Those skilled in the art will appreciate that FIG. 8 includes other related functionality.

Figure 9:
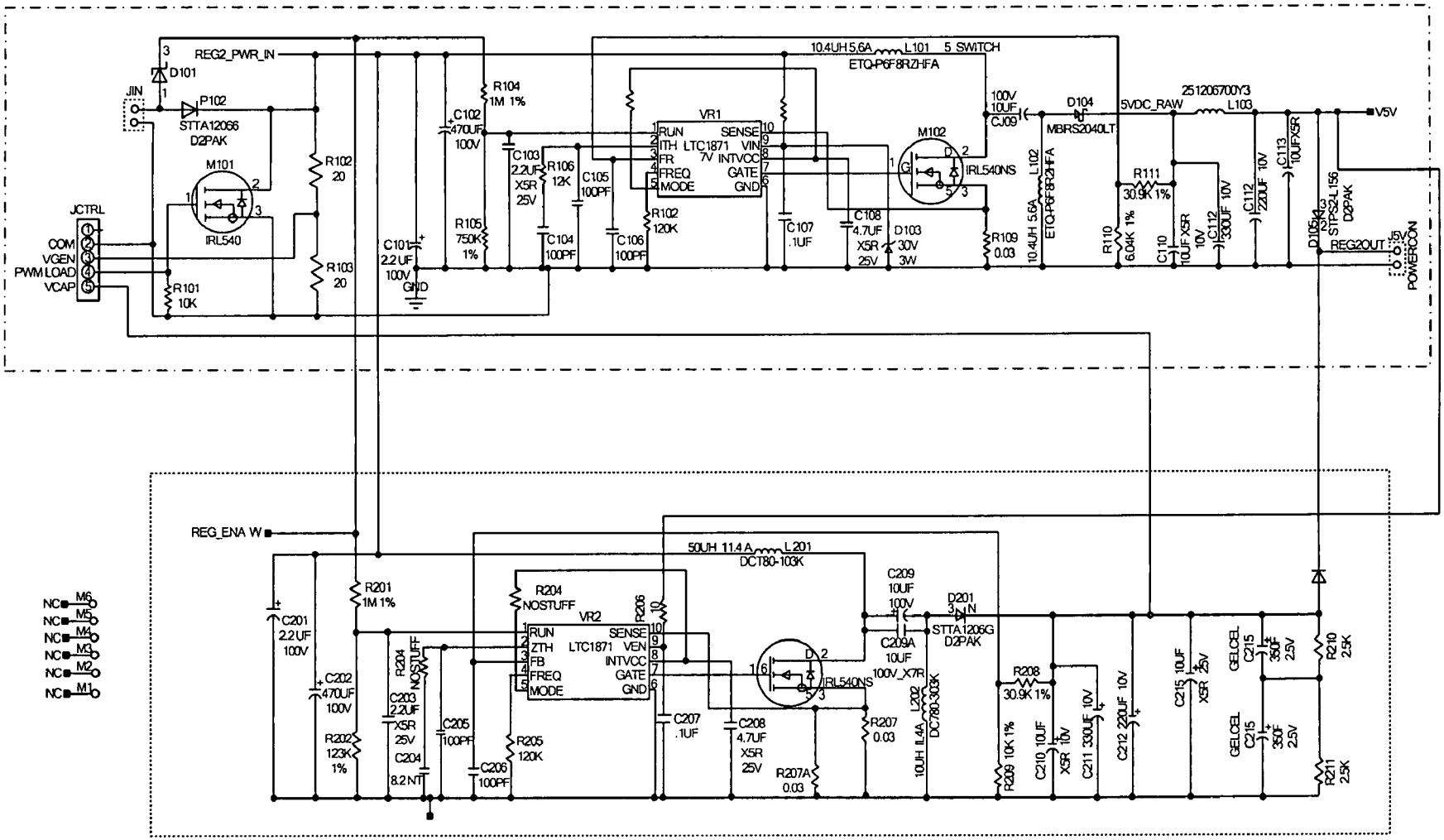
FIG. 9 is a diagram of a power regulation circuit.

FIG. 9 is a diagram of a power regulation circuit. In accordance with one aspect of the present invention, the power regulation circuit regulates power for the interactive activity system. In one embodiment, the circuit is configured such that a constant voltage is provided to a main control board regardless of the charge state of the power storage devices. In another embodiment, power is provided to a charge circuit to charge the power storage device(s) at a maximum current rate. In yet another embodiment, a tractive load is applied to the generator to provide a relatively constant load.

Figure 10:
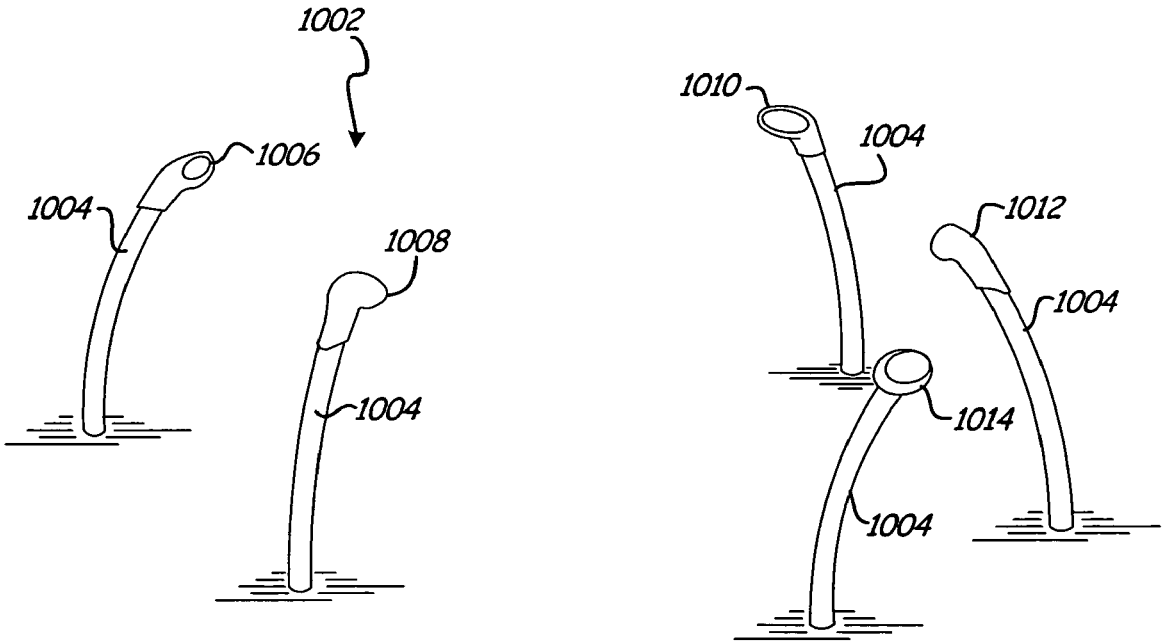
FIG. 10 is a perspective view of an external device.

FIG. 10 is a plan view of one example of an external device 1002. Device 1002 is illustratively situated within an interactive environment and configured to operate, as described herein in relation to devices 106 and 508, based at least partially on electrical power generated and/or stored within the same environment.

Device 1002 includes a plurality of posts 1004. Each post 1002 has a display member positioned on one end. Within FIG. 10, the display members are labeled 1006-1014. The end of each post opposite the display member is attached to a surface such that the posts 1002 are set in a fixed position. While the present invention is not limited to any specific dimensions, posts 102 are illustratively 42 inches tall.

At least one elongated conductor (e.g., a wire) extends through each post 1002 and is electrically connected to circuitry associated with display members 1006-1014. The elongated conductor(s) is also attached to a power distribution component (e.g., a regulator board) and/or a power storage component. In this manner, display members 1006-1014 receive electrical power necessary for their operation. In one embodiment, the power supplied to members 1006-1014 is generated and/or stored within the same play environment, as is described above at least in relation to FIGS. 1 and 5.

In one embodiment, the elongated conductor(s) connecting display members 1006-1014 to an associated source of electrical power extend through an underground conduit that runs between the power source and posts 1004. Those skilled in the art will appreciate that this enables the elongated conductor to be at least partially if not entirely concealed from users that might interact with device 1002.

Each of display components 1006, 1008, 1010 and 1012 is illustratively a playing station. While the present invention is not limited to any particular post pattern, the playing stations are illustratively located approximately 15 feet apart in a square pattern. Display component 1014 is illustratively a control station. The control component is illustratively configured to enable a user to select and start a game to be played in association with the playing stations. In one embodiment, once a game is started, game play happens through user interaction with one or more of the playing stations. In one embodiment, the control station supports at least three different options that can be selected for game play. One option is a "remember the order game." Another options is a "follow the lights" game. Another options is a "keep the lights on" game.

Figure 11:
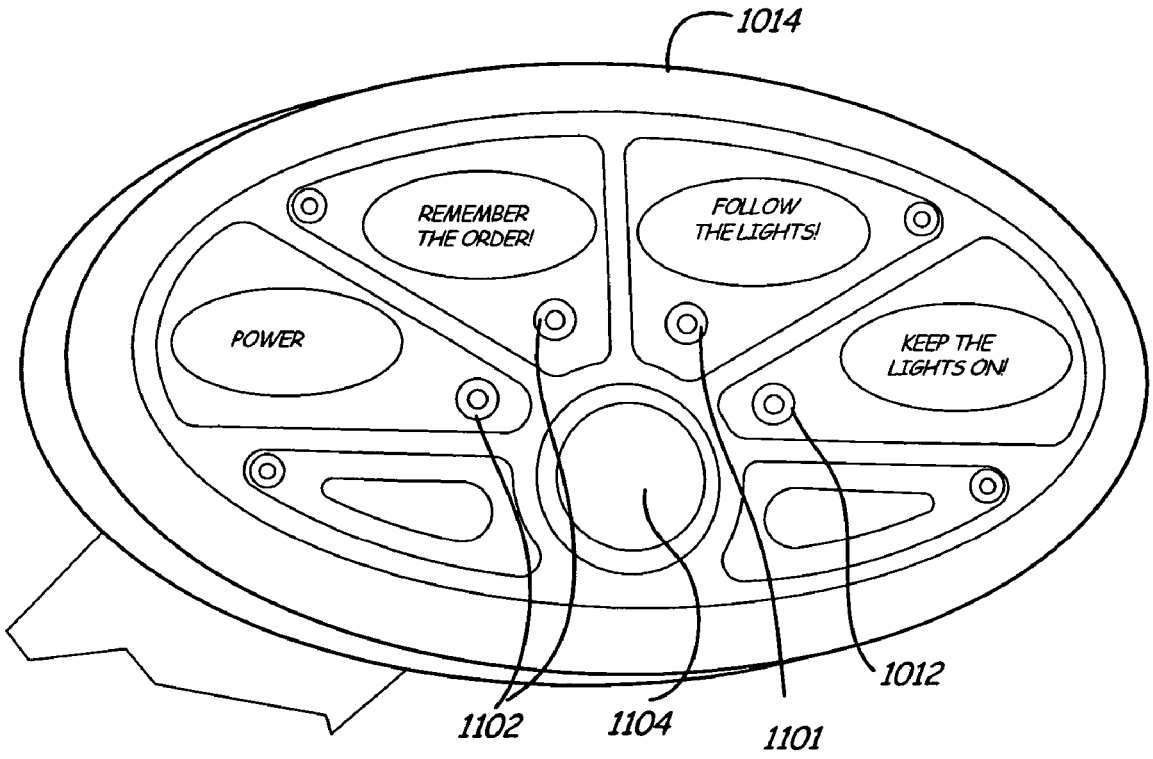
FIG. 11 is a detailed view of a portion of the external device.

FIG. 11 is a close-up view of control station 1014. Station 1014 provides a means to select and start the version of the game to be played. All the games illustratively use the same play stations. In one embodiment, the electrical power that runs stations 1006-1014 is provided from an on-site power system located within the same overall interactive environment (e.g., similar to the set up of the system described in relation to FIG. 1). In one embodiment, system 1002 will only function if a predetermined amount of power has been generated and/or is available for consumption (e.g., games can only be played if there is enough electrical power to support operation for a predetermined amount of time, etc.).

Figure 12:
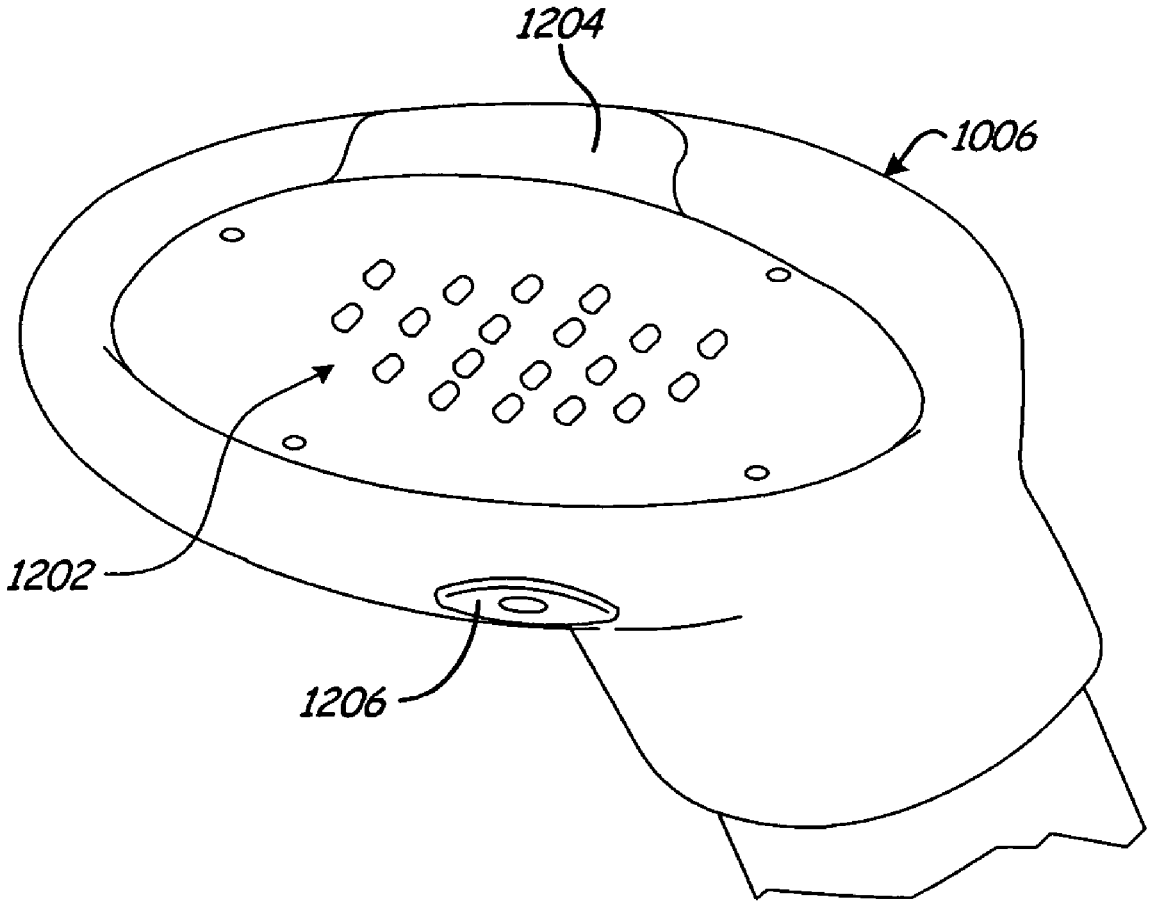
FIG. 12 is a detailed view of another portion of the external device.

FIG. 12 is a close-up view of the playing station 1006. The station includes an LED display 1202, a speaker opening 1206 and a button 1204 to be utilized during the play of at least one selected game. All three components are configured to function as necessary to support a particular game or application.

In one embodiment of a remember the order game, the playing posts are each a different color. The user observes the LED displays of the posts lighting up in a particular pattern. The user then presses the buttons in attempt to repeat the observed pattern. The pattern becomes progressively longer are the user is successful in repeating the pattern.

In one embodiment of a follow the lights game, after a light lights up, the user presses the corresponding button. This process is repeated and can bounce between different posts. The time between flashing lights accelerates. The user continues until he or she cannot keep up with the light any longer.

In one embodiment of a keep the lights on game, the user presses the button of an LED display that is not lit up. Pressing the button causes the light to light up. The user repeats this process in an effort to keep all LED displays lit up. The speed at which light go out accelerates. The game ends when the user can no longer keep all the lights on.

In one embodiment, at least one display is provided, or a sound is provided through the speakers, as an indication of how well the user did. For example, an indication of the user's score is provided as an incentive to try again to beat one's score, or an incentive to beat someone else's score. In one embodiment, high scores, personal bests, etc. can illustratively be stored and retrieved in any manner the same or similar to that described above in relation to the generator display.

Figure 13:
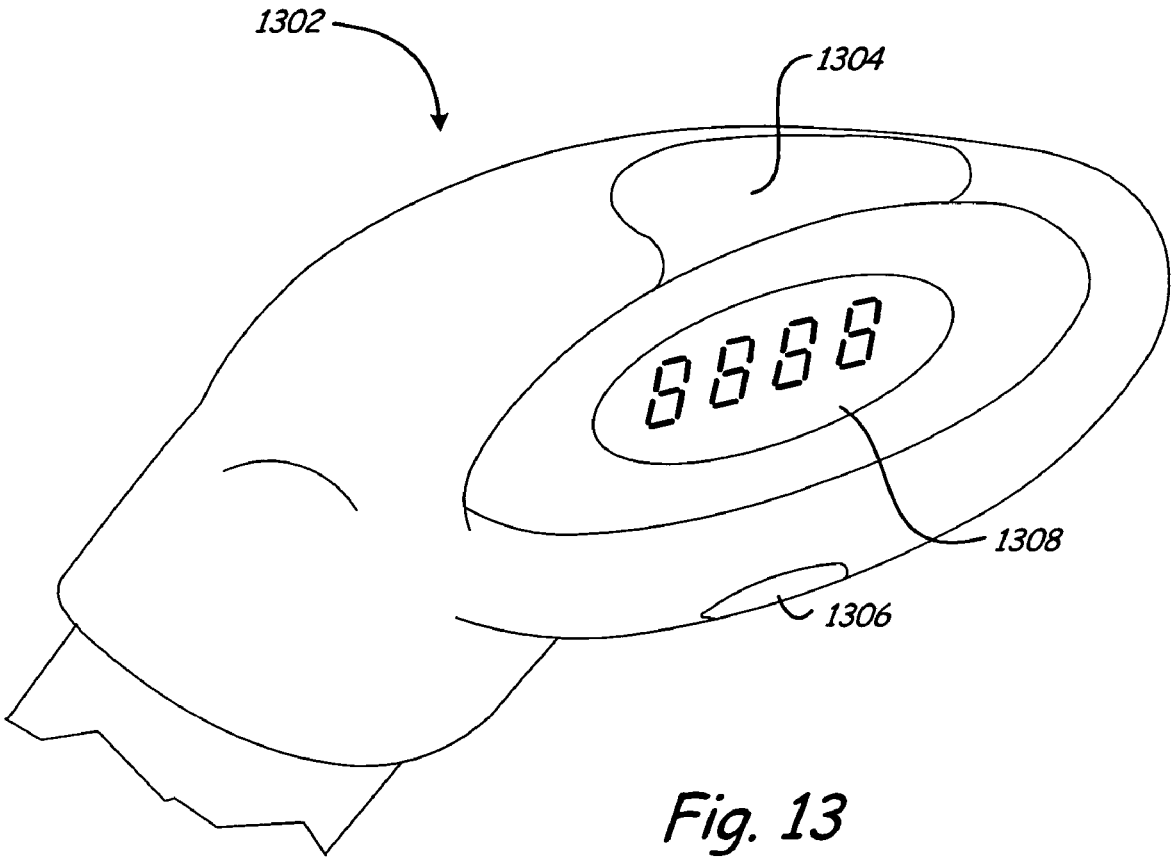
FIG. 13 is a detailed view of another portion of the external device.

FIG. 13 is a close-up view of a timer component that can be included one an illustrated post 1004 and/or on a separate post. In one embodiment, timer component 1302 operates like an ordinary stopwatch. In one embodiment, timer 1302 is provided as a solitary, free-standing device, independent of any other games or games posts. In other words, timer 1302 can be provided for utilization for "free play" purposes wherein there is not necessarily any predetermined intent and the user decides how it is to be used. A start/stop button 1304 illustratively enables a user to start, stop and reset a counter display 1308. A speaker opening is also provided to support applications with sound.

In one embodiment, the electrical power that runs station 1302 is provided from an on-site power system located within the same overall interactive environment (e.g., similar to the set up of the system described in relation to FIG. 1). In one embodiment, system 1302 will only function if a predetermined amount of power has been generated and/or is available for consumption (e.g., games can only be played if there is enough electrical power to support operation for a predetermined amount of time, etc.).

Those skilled in the art will appreciate that the term "generator" as used herein is not intended to be narrowly construed. For example, without departing from the scope of the present invention, an alternator could just as easily be implemented to server the generator functions described herein.

Although the present invention has been described with reference to preferred embodiments, workers skilled in the art will recognize that changes may be made in form and detail without departing from the spirit and scope of the invention.

What is claimed is:

1. A playground, comprising:

a generator device;

a storage component configured to receive and store electrical power produced as a byproduct of physical interaction with the generator device;

a plurality of posts; and at least one play-oriented application configured to operate utilizing at least a portion of the electrical power, the at least one play-oriented application including a visual indicator and user actuable buttons, the at least one play-oriented application being supported by at least one of the plurality of posts.

2. The playground of claim 1, wherein the generator device is configured for physical interaction with a user, and wherein the playground further comprises a multi-functional power regulation system, the multi-functional power regulation system regulating power generated by the generator device in at least three different ways, a first one of the at least three different ways including providing a constant voltage to a main control board that runs the at least one play-oriented application, a second one of the at least three different ways including providing power to a charge circuit to charge the storage component, and a third one of the at least three different ways including applying a tractive load to the generator device.

3. The playground of claim 2, wherein the play-oriented application is configured to become non-functional if the electrical power in the storage component drops below a minimum level.

4. The playground of claim 3, wherein the play-oriented application is an electronic interactive game, and wherein the playground further comprises a speaker that produces sounds associated with the electronic interactive game.

5. The playground of claim 1, wherein the generator device is configured to facilitate the physical interaction, and wherein the playground is configured to utilize user log-in information.

6. The playground of claim 1, wherein the play-oriented application can only be played if there is enough electrical power to support operation of the play-oriented application for a predetermined amount of time.

7. The playground of claim 1, wherein each of the plurality of posts includes a button, a light, and at least one elongated conductor that extends through the post, each of the conductors being electrically connected to circuitry associated with the button and the light, each of the conductors also being electrically connected to the storage component, the buttons and the lights configured to receive electrical power for their operation from the storage component.

8. The playground of claim 7, wherein the play-oriented application includes a plurality of user-selectable games, the user-selectable games comprising a "remember the order" game, a "follow the lights" game, and a "keep the lights on" game, the "remember the order" game including the post lights lighting up in a particular pattern and a user pressing the post buttons to repeat the particular pattern, the "follow the lights" tame including the user pressing the button associated with a post in response to the light of the post lighting up, and the "keep the lights on" game including the user pressing the button of one of the posts to light up the light associated with the one of the posts, and the user continuing to press the buttons associated with the remainder of the plurality of posts to light up the lights associated with the remainder of the plurality of posts.

9. The playground of claim 1, wherein the plurality of posts comprises at least four posts, each of the at least four posts including a curved elongated cylindrical body and a speaker opening.

10. A playground, comprising:

a generator device;

a storage component configured to receive and store electrical power produced as a byproduct of physical interaction with the generator device;

a play-oriented game configured to operate utilizing at least a portion of the electrical power;

a plurality of elongated cylindrical posts:

a user interface for the play-oriented game, the user interface being supported at least in part by the plurality of elongated cylindrical posts, the user interface including a light, a speaker, and a user actuable button; and a multi-functional power regulation system that provides power to charge the storage component and that also provides a voltage to a main control board that runs the play-oriented game.

11. The playground of claim 10, wherein the physical interaction is a rotating of a power generating mechanism that is part of the generator device.

12. A playground, comprising:

a generator device that includes a rotatable power generating mechanism;

a storage component configured to receive and store electrical power produced as a byproduct of user rotating the rotatable power generating mechanism;

a play-oriented game configured to operate utilizing at least a portion of the electrical power;

at least one cylindrical elongated post that is configured to be secured to a ground surface; and a display that is supported at least in part by the at least one cylindrical elongated post and that provides a user interface for the play oriented game.

13. The playground of claim 12, wherein the play-oriented game provides a visual output of biofeedback information.

* * * * *